US007721510B2

(12) United States Patent
Yuyama et al.

(10) Patent No.: US 7,721,510 B2
(45) Date of Patent: May 25, 2010

(54) VIAL CAPPING DEVICE AND VIAL CAPPING METHOD

(75) Inventors: Shoji Yuyama, Toyonaka (JP); Katsunori Yoshina, Toyonaka (JP); Yoshihiko Ide, Toyonaka (JP)

(73) Assignee: Yuyama Mfg. Co., Ltd., Toyonaka-shi (JP)

( * ) Notice: Subject to any disclaimer, the term of this patent is extended or adjusted under 35 U.S.C. 154(b) by 176 days.

(21) Appl. No.: 11/815,599

(22) PCT Filed: Feb. 6, 2006

(86) PCT No.: PCT/JP2006/302002

§ 371 (c)(1),
(2), (4) Date: Aug. 6, 2007

(87) PCT Pub. No.: WO2006/082969

PCT Pub. Date: Aug. 10, 2006

(65) Prior Publication Data

US 2009/0013642 A1 Jan. 15, 2009

(30) Foreign Application Priority Data

Feb. 7, 2005 (JP) ..... 2005-030508

(51) Int. Cl.
*B67B 1/06* (2006.01)

(52) U.S. Cl. ..... 53/317; 53/331.5; 53/490

(58) Field of Classification Search ..... 53/331.5, 53/317, 305, 490
See application file for complete search history.

(56) References Cited

U.S. PATENT DOCUMENTS 4,156,490 A * 5/1979 Peraboni ..... 215/252
4,278,180 A * 7/1981 Willis ..... 215/252
4,807,770 A * 2/1989 Barriac ..... 215/252
4,846,361 A * 7/1989 Haffner ..... 215/252
4,886,495 A * 12/1989 Reynolds ..... 604/88
5,702,017 A * 12/1997 Goncalves ..... 220/23.4
H001777 H * 2/1999 Colby ..... 53/331.5
5,913,437 A * 6/1999 Ma ..... 215/252
5,938,055 A * 8/1999 Philips et al. ..... 215/222
6,382,440 B1 * 5/2002 Brant et al. ..... 215/230
7,003,932 B2 * 2/2006 Mavin ..... 53/490
7,082,739 B2 * 8/2006 Guernieri et al. ..... 53/367
7,293,396 B1 * 11/2007 Cunningham ..... 53/490

FOREIGN PATENT DOCUMENTS

JP 62 146193 6/1987
JP 2000 109183 4/2000
JP 2001 122392 5/2001

* cited by examiner

*Primary Examiner*—Sameh H. Tawfik
(74) *Attorney, Agent, or Firm*—Oblon, Spivak, McClelland, Maier & Neustadt, L.L.P.

(57) ABSTRACT

A vial capping device includes a cap installation ring, a holding device, a movement device, and a tightening motor. The cap installation ring has an inner periphery thread to be threadedly engaged with a thread of an outer peripheral surface of a cap. The holding device holds a vial during fastening. The movement device brings a thread of the inner peripheral surface of the cap attached to the cap installation ring and an opening of the vial closer to each other. The tightening motor rotates one or both of the cap installation ring engaged with the cap and the holding device holding the vial. Thus, the vial capping device with a simple construction reliably fastens the cap to the vial.

13 Claims, 27 Drawing Sheets

Figure 18A BACKGROUND ART
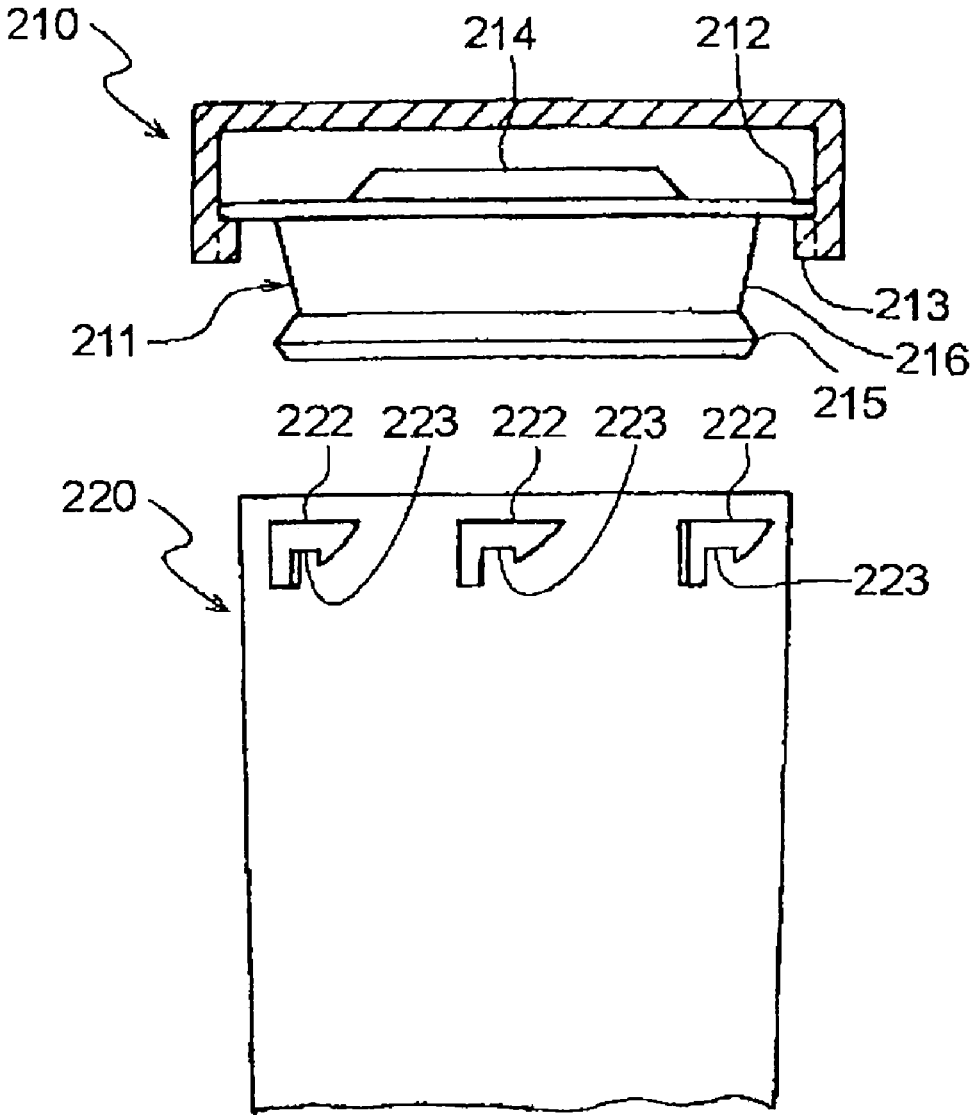

VIAL CAPPING DEVICE AND VIAL CAPPING METHOD

TECHNICAL FIELD

The present invention relates to a vial capping device endowed with a function by which rotation of a cap is locked through engagement of a cap engagement portion and a rotation restricting portion of a vial, and to a capping method.

BACKGROUND ART

FIG. 17 shows a filling device for filling a vial with tablets in which a cap 210 is put on a vial 220 to seal in tablets. A medicinal information label 221 for a patient is affixed to the side surface of the vial 220. The vial 220, which has been in use for a long period of time, is devised so as to prevent an infant from opening the vial easily. That is, to open it, it is necessary to press the upper surface of the cap against the vial while turning the cap, so even an adult cannot open the cap easily, which results in a bother.

As shown in FIG. 18A, the cap 210 has an inner cover 211 on its inner side. A flange portion 212 of the inner cover 211 is held by engagement portions 213 protruding on the inner side of the cap 210. As shown in FIG. 18B, the engagement portions 213 is engaged with engagement grooves 223 of rotation restricting portions 222 of the vial 220, whereby the cap 210 is locked to the vial 220. The inner cap 211 is equipped with a tension protrusion 214; when the cap 210 is locked to the vial 220, the tension protrusion 214 comes into contact with the inner surface of the cap 210 to raise the cap 210, acting thereon so as to maintain the engagement of the engagement portions 213 and the engagement grooves 223. A moisture-proof ring 215 provided on the inner cover 211 of the vial comes into contact with the inner wall of the vial 220. Since it is equipped with an escape portion 216, the moisture-proof ring 215 reliably comes into contact with the inner periphery of the vial 220, so the tablets absorb no moisture and their quality is maintained. When the cap 210 is pressed against the vial 220, the tension protrusion 214 is crushed, and the engagement portions 213 are detached from the engagement grooves 223 of the rotation restricting portions 222. When, in this state, the cap 210 is turned counterclockwise, the cap 210 can be opened.

The cap 210 and the vial 220, which are constructed as described above, involve a rather bothersome operation. As a result, in recent years, a combination of a vial 1 and a cap 2 as shown in FIG. 19 has come to be sold and put into use. The vial 1 has a structure for preventing an infant from accidental swallowing. The vial 1 has a vial outer periphery thread 4 on the outer peripheral surface of a vial opening 3, and an inner periphery thread 5 on the inner peripheral surface thereof. The cap 2 has a cap inner periphery thread 6 on the inner peripheral surface thereof which is to be threadedly engaged with the vial outer periphery thread 4 of the vial 1. Further, in order to be capable of being threadedly engaged also with the vial inner periphery thread 5 provided at the opening 3 of the vial 1, the cap 2 has a small diameter portion 8 whose diameter is smaller than that of a large diameter portion 7 on which the cap inner periphery thread 6 is provided, with a cap outer periphery thread 9 being provided on the outer peripheral surface thereof.

The vial 1 has a disc-like flange 10 which is partially cut-away so that it may substantially come into contact with the lower edge of the cap 2 when the cap inner periphery thread 6 of the cap 2 is threadedly engaged with the vial outer periphery thread 4. Further, the vial 1 has, in the cut-away portion of the flange 10, a lever 11 whose distal end can be pushed down, with the lever 11 being equipped with a rotation restricting member 12 formed of an elastic latch member protruding obliquely upwards. Further, the cap 2 has a protrusion-like engagement portion 13 at the lower end of the inner surface thereof; when the inner periphery thread 6 of the cap 2 is threadedly engaged with the vial outer periphery thread 4 of the vial 1, the engagement portion 13 climbs over the rotation restricting member 12 while pushing it down and, afterwards, the rotation restricting member 12 protrudes upwardly again due to its elasticity. Even if an attempt is made to turn the cap 2 in the opening direction, the engagement portion 13 abuts the rotation restricting member 12 to restrict the rotation of the cap 2. Thus, in order to detach the cap 2 from the vial 1, it is necessary to turn the cap 2, with the lever 11 being pushed down to downwardly retract the rotation restricting member 12 below the engagement portion 13. Since an infant is incapable of performing such an operation, it is possible to prevent accidental swallowing. Further, when there is no fear of an infant touching the vial 1, the cap 2 is turned upside down, and the outer periphery thread 9 of the cap 2 is threadedly engaged with the vial inner periphery thread 5 of the vial 1. As a result, the rotation restricting member 12 is not engaged with the engagement member 13, and the cap can close the vial so as to easily allow its detachment, so the user feels no bother.

In conventional vial capping devices, it is necessary to rotate one of a mechanism for holding the vial and the other mechanism for holding the cap to lock or threadedly engage the cap to or with the vial, resulting in a rather complicated device structure. Further, in some cases, the holding of the cap is rather insufficient, and the cap spins, resulting in a rather insufficient tightening of the cap. In particular, in the case of a capping device for threadedly engaging the cap 2 with the vial 1 shown in FIG. 19, it is necessary to hold the cap 2, which is of a complicated configuration due to the provision of the small diameter portion 8 equipped with the cap outer periphery thread 9, resulting in problems such as a rather complicated device structure, a poor reliability in holding, and defective tightening due to spinning of the cap.

DISCLOSURE OF THE INVENTION

Problem to be Solved by the Invention

In view of the above-mentioned problems in the prior art, it is an object of the present invention to provide a vial capping device and a vial capping method allowing the cap to be reliably fastened to the vial with a simple construction.

Means for Solving the Problem

To solve the above-mentioned problems, a vial capping device according to the present invention relates to a vial capping device, in which a thread is provided respectively on an inner peripheral surface and an outer peripheral surface of a cap, a thread being provided on an outer peripheral surface of a vial opening, the cap being equipped with an engagement portion, the vial being equipped with a rotation restricting portion, the vial being closed by threadedly engaging the thread of the inner peripheral surface of the cap with the vial opening, rotation of the cap being locked through engagement of the engagement portion of the cap and the rotation restricting portion of the vial, the vial capping device including: a cap installation ring equipped with an inner periphery thread to be threadedly engaged with the thread of the outer peripheral surface of the cap; a holding device for holding the vial; a movement device for bringing at least one of the thread of the inner peripheral surface of the cap attached to the cap installation ring and the opening of the vial close to the other; and a tightening motor for rotating at least one of the cap and the vial.

Further, a plurality of cap installation rings may be provided, and a plurality of kinds of diameter sizes of the cap installation rings may be provided in correspondence with the kinds of diameters of vials.

Further, when a torque limiter is provided somewhere between the tightening motor for rotating at least one of the cap and the vial and the cap or the vial, it is possible to prevent damage of the motor.

Further, when there are provided below the cap installation ring a cap supply portion to which the cap is supplied so as to be substantially coaxial with the cap installation ring and an approach device for moving at least one of the cap supplied to the cap supply portion and the cap installation ring so as to bring them close to each other, it is possible to automatically attach the cap to the cap installation ring.

Further, when there is provided an installation motor which rotates at least one of the cap and the cap installation ring to threadedly engage the cap installation ring with the cap supplied to the cap supply portion, it is possible to attach the cap supplied to the cap supply portion through threaded engagement by rotating the installation motor.

Further, when there is provided a torque limiter in the rotation transmission route from the installation motor to the cap or the cap installation ring, it is possible to attach the cap to the cap installation ring with an appropriate torque, thereby preventing damage of the motor.

Further, when there is provided a retraction mechanism which causes the cap supply portion to retract from between the threadedly engaged cap and the vial opening after the cap supplied to the cap supply portion and the cap installation ring have been threadedly engaged with each other, it is possible to close (cap) the vial immediately after the cap supplied is threadedly engaged with the cap installation ring.

When there are provided a chute for supplying a stored cap to the cap supply portion, and a stopper for stopping the cap between the cap supply portion and the chute, and when the stopper is detached to supply a cap if there is no cap at the cap supply portion, it is possible to perform vial capping reliably one by one.

Further, according to the present invention, there is provided a vial capping method for a vial capping device in which a thread is provided on each of an inner peripheral surface and an outer peripheral surface of a cap, a thread being provided on an outer peripheral surface of a vial opening, the cap being equipped with an engagement portion, the vial being equipped with a rotation restricting portion, the vial being closed by threadedly engaging the thread of the inner peripheral surface of the cap with the vial opening, rotation of the cap being locked through engagement of the engagement portion of the cap and the rotation restricting portion of the vial, by which cap tightening can be reliably effected by the following procedures:

a) a procedure to threadedly engage the thread provided in the inner periphery of a cap installation ring and an outer periphery thread of the cap;

b) a procedure to bring the thread of the outer peripheral surface of the vial opening close to the thread portion of the cap inner peripheral surface; and c) a procedure to rotate the cap installation ring in the closing direction by a motor.

Further, in the above-mentioned procedure a), when the cap installation ring is rotated until the cap engagement portion and the rotation restricting portion of the vial are engaged with each other to lock the cap, it is possible to exert a function by which accidental swallowing by an infant is prevented.

Further, when, after the cap has been locked, it is possible to successively perform capping on the next vial by performing the following procedure:

d) a procedure to rotate the cap installation ring in the reverse direction to cancel the threaded engagement of the thread of the cap installation ring and the outer periphery thread of the cap.

Further, it is possible to automatically attach the cap to the cap installation ring by performing the following procedures:

e) a procedure to mount the cap to a cap supply portion provided under the cap installation ring so as to be coaxial with the cap installation ring;

f) a procedure to bring the cap installation ring close to the cap supply portion; and g) a procedure to rotate at least one of the cap mounted to the cap supply portion and the cap installation ring to threadedly engage the cap and the cap installation ring with each other.

Effects of the Invention

According to the vial capping device of the present invention, the cap outer periphery thread of the cap is threadedly engaged with the ring inner periphery thread of the cap installation ring, so it is possible to reliably hold the cap. Further, when engaging the cap threadedly engaged with the cap installation ring threadedly with the outer periphery thread of the vial, the torque of the cap or of the cap installation ring is exerted so as to threadedly engage the cap with the cap installation ring, so the cap holding state is stabilized, and it is possible to perform capping on the vial reliably with a simple configuration.

Further, in the vial capping device of the present invention, when a plurality of cap installation rings are provided, it is possible to perform capping on vials of different diameters, and when a torque limiter is provided, there is no fear of excessively tightening the cap to damage the cap or burning the motor.

As described above, according to the present invention, it is possible to provide a vial capping device and a vial capping method allowing a cap to be fastened to a vial reliably with a simple configuration.

BEST MODE FOR CARRYING OUT THE INVENTION

In the following, an embodiment of the present invention will be described with reference to the drawings.

FIGS. 1 and 2 show a tablet filling device 21 that is equipped with a vial capping device according to the present invention. The tablet filling device 21 is composed of three vial accommodating portions 22, a cassette accommodating portion 23, a cap accommodating portion 24, vial discharge portions 25, and a PC accommodating portion 26.

Each vial accommodating portion 22 has a door 27 on one side thereof as shown in the drawing, which door is opened to accommodate vials 1. The vials 1 accommodated in the vial accommodating portions 22 are extracted one by one and are conveyed to a robot arm (not shown).

The cassette accommodating portion 23 is provided on either side of the tablet filling device 21; a robot arm (not shown) directly moves the vial 1 to the back surface of the target tablet cassette, and imparts dispensing power to the drug cassette from the back side of the tablet cassette to introduce the requisite number of tablets into the vial 1. The vial 1 filled with tablets is conveyed to a capping device described below by means of the robot arm.

The cap accommodating portion 24 is equipped with a cap supply unit 100 described below, and conveys caps 2 one by one to the capping device with their orientations aligned. The replenishment of the cap accommodating portion 24 with caps 2 is effected through a door 28.

The vial discharge portions 25 are windows through which the vials 1 completely filled with tablets are discharged while classified into different groups for different patients.

The PC accommodating portion 26 accommodates a PC, which is connected to a pharmacy host computer through a LAN; it transmits prescription data that is received from the pharmacy host computer to a main body control portion, and displays operational information of the corresponding data through an operation monitor 29.

The capping device is composed of a cap installation unit 31 and a robot arm 71. FIGS. 3, 4, and 5 show the cap installation unit 31. The caps 2 slide on a chute 32 by their own weight to a cap supply portion 33 in a state in which they are aligned with the openings of inner peripheral threads 6 provided on the caps 2 facing downwardly. The cap supply portion 33 is composed of a pair of L-shaped guides 34 opposed to each other and arranged substantially parallel to the direction in which the caps 2 are supplied.

Above the cap supply portion 33, there is provided a cap installation ring 35 at a position where it is substantially coaxial with the cap 2 supplied to the cap supply portion 33. One end portion of a support shaft 36 is inserted into a hole that is provided in the cap installation ring 35, and the cap installation ring 35 is rotatable around the support shaft 36 and axially slidable along the support shaft 36. The other end of the support shaft 36 is supported by a motor bracket 37. Substantially in the middle of the support shaft 36, there is provided a drive gear 39 that is supported by a bearing 38. Since an E-ring is attached to the cap installation ring 35 side of the drive gear 39, the drive gear 39 does not fall from the support shaft 36. The drive gear 39 is driven by being in mesh with a motor gear 40. The motor gear 40 is driven by a rotation motor (which serves as both tightening motor and installation motor) 42 via a speed reduction gear 41 and a torque limiter 41*a*. The cap installation ring 35 is suspended from the drive gear 39 by a pair of ring support shafts 43 that are situated on both sides of the support shaft 36. The ring support shafts 43 slidably extend through holes provided in the drive gear 39; their upper ends are larger than the holes of the drive gear 39, and their lower ends are fixed to the upper surface of the cap installation ring 35 by screws. Further, a compression spring 44 is provided around the portion of the support shaft 36 which is between the cap installation ring 35 and the bearing 38 provided on the drive gear 39, pressing the cap installation ring 35 downwardly. The cap installation unit 31 including the motor bracket 37 form a structure that is capable of ascending and descending, so they are mounted to a bracket 46 capable of ascending and descending along an ascent/descent slide shaft 45, and the bracket 46 is caused to ascend and descend by a screw of an ascent/descent drive shaft 47 (approach device). The ascent/descent drive shaft 47 is equipped with a bevel gear 48; a bevel gear 49 of a motor 50 is in mesh with the above-mentioned bevel gear 48, and the ascent/descent drive shaft 47 rotates through driving of the motor 50, causing the bracket 46 to ascend and descend. Both end portions of the ascent/descent drive shaft 47 are rotatably supported by bearings, and the bearings and the ascent/descent slide shaft 45 are mounted to a structure 51, whereby the cap installation unit 31 as a whole is supported.

A protrusion 52 for position detection is provided on the bracket 46, and the structure 51 is equipped with a position detecting sensor 53 for detecting a protrusion 62 at an upper limit position and a lower limit position of the bracket 46. The position detecting sensor 53 is a transmitted-light detecting sensor; when the protrusion 52 reaches a gap portion of the main body of the sensor 53, light is intercepted, whereby the position of the bracket 46 is detected. The upper limit position is of a height not hindering the charging of the cap 2 to the cap supply portion 33, and the lower limit position is of a height allowing the thread portions 4, 6 of the cap 2 and the vial 1 to come into contact with each other when they are to be threadedly engaged with each other.

Further, in the present invention, the drive gears 39 are provided on each side of the motor gear 40 being centered, and the cap installation rings 35 of different diameters are provided on the drive gears 39 so as to be in conformity with the kinds of vial 1 to be treated by the cap installation unit 31. The structures on both sides, however, are as described above except that they differ from each other in diameter.

Further, a solenoid 54 is provided above the cap supply portion 33 and on the front side thereof with respect to the cap supply direction, and the plunger of the solenoid 54 is connected to a lever 55*a*, and a stopper 55 is mounted to the forward end of the lever 55*a*. In order that the next cap 2 that is on standby on the chute 32 may not move to the cap supply portion 33 at the time of cap installation to hinder the cap tightening, the stopper 55 abuts the upper portion of the next cap 2 to cause it to stop at that position. The chute 32 is equipped with a sensor 32*a*, which detects whether there are any cap 2 at the cap supply portion 33. When there is no more cap 2 at the cap supply portion 33, an electric current flows through the solenoid 54, and the stopper 55 ascends, canceling the abutment of the cap 2 and causing the cap 2 to move to the cap supply portion 33.

FIG. 6 is a perspective view, as viewed from below, of the vial 1, the cap 2, and the cap installation ring 35. An installation ring inner periphery thread 56 is provided in the inner periphery of the cap installation ring 35. The installation ring inner periphery thread 56 is to be threadedly engaged with a cap outer periphery thread 9 provided on a small diameter portion 8 of the cap 2 which is of a smaller diameter than a large diameter portion 7 thereof.

FIGS. 7A and 7B show the construction of L-shaped guides 34 (retraction mechanism) on which the cap 2 is mounted. The L-shaped guides 34 are rotatable around guide rotation shafts 57, and are equipped with transmission gears 58 for equalizing the rotation angles of the opposing L-shaped guides. Further, springs 59 are stretched between the opposing L-shaped guides 34, urging them toward each other, with the parallel position being the limit. A transmitting protrusion 60 is provided on one of each pair of L-shaped guides 34, and, a slide transmission rail 61 is provided under the same; at one end of the slide transmission rail 61, there is provided a bearing 62 in contact with the transmitting protrusions 60; the other end thereof is coupled to an arm 64 connected to a solenoid 63.

The slide transmission rail 61 is mounted so as to extend through a structure support plate 51, and is provided so as to be longitudinally slidable along a guide (not shown). Substantially at the center of the slide transmission rail 61, there is provided an elongated hole 66 engaged with a position regulating bearing 65 supported by the structure support plate 51. When no power is being supplied to the solenoid 63, the position regulating bearing 65 is in contact with the arm 64 side of the elongated hole 66 a shown in FIG. 7A. When power is supplied, the position regulating bearing 65 comes into contact with the L-shaped guide 34 side of the elongated hole 66 as shown in FIG. 7B. The L-shaped guides 34 are adjusted so as to be substantially parallel when the position regulating bearing 65 is in contact with the arm 64 side of the elongated hole 66. Above each pair of L-shaped guides 34, there is provided a stopper 33*b* at the forward ends of a pair of support arms 33*a* extending from the structure support member 51. The cap 2, which comes sliding from the chute 32, abuts the stopper 33*b*, and is correctly stopped at the cap supply portion 33.

FIG. 8 is a perspective view of the robot arm (which serves both as a holding device and a movement device) 71 provided under the cap installation unit 31. The robot arm 71 serves to perform cap tightening on the vial 1 that has completed filling, and to convey the vial 1 to the vial discharge portion 6 shown in FIG. 1. In the robot arm 71, rail members 73 are provided upright at both longitudinal ends of a unit casing portion 72, with the robot arm ascending and descending along the rail members 73. The drive source for the ascent and descent is provided as follows: shafts (not shown) that are substantially parallel to the unit casing portion 72 are provided at the upper and lower ends of the ascent/descent range, and two timing belts (not shown) are stretched between pulleys (not shown) provided on the shafts, with one side of each timing belt being fixed to the unit casing portion 72; the drive source is provided by running these timing belts. Sensors (not shown) are provided at the upper and lower ends of the ascent/descent range, preventing overrunning of the robot arm beyond the ascent/descent range.

On the unit casing portion 72, there is provided a horizontal rotation gear 74 horizontally rotatable around a rotation shaft (not shown). The horizontal rotation gear 74 is engaged with a horizontal rotation drive gear 75; when a horizontal rotation drive motor 76 rotates, the horizontal rotation gear 74 is rotated via the horizontal rotation drive gear 75 owing to a drive force thereof. Further, the horizontal rotation gear 74 has an encoder (not shown) on its rotation shaft, and an origin protrusion 74*a* on the back surface thereof; the rotating position where a sensor (not shown) provided in the unit casing portion 72 detects the origin protrusion is used as the origin. By using the encoder, it is possible to control the stop position, etc. according to the number of slits and blinds as counted from the origin. Further, on the planar rotation gear 74, there is provided a slide rail support plate 77, and a slide rail (not shown) is provided between the slide rail support plate 77 and an arm unit support plate 78. Further, on the slide rail support plate 77, there is arranged a rack gear 79 so as to be substantially parallel to the slide rail; the slide rail is expanded and contracted by an expansion/contraction gear 80 in mesh with the rack gear 79, and an expansion/contraction drive motor 81 supported on the arm unit support plate 78 side, causing the slide rail support plate 78 to move. Further, the robot arm 71 is equipped with a sensor 82 for detecting the slide limit.

FIG. 9 is a plan view of the robot arm 71. A pair of arm members 83 are supported by the arm unit support plate 78 so as to open and close around an arm shaft 84, and a grasping drive shaft 85 is provided so as to extend through the central portion of the arm members 83, and both ends thereof are supported on the arm unit support plate 78 by means of bearings.

FIG. 10 is a perspective view, as viewed from the front side, of the robot arm 71. The grasping drive shaft 85 has on the right-hand and left-hand sides of substantially the center thereof a left-handed screw and a right-handed screw, respectively. When the grasping drive shaft 85 rotates in one direction, the pair of arm members 83 move toward or away from each other. At the portions where it crosses the arm members 83, the grasping drive shaft 85 is threadedly engaged with nuts 86 as the left-handed screw and the right-handed screw. As shown in FIG. 9(B), each nut 86 has an attitude correction shaft 87, the upper end of which is rotatably supported by the corresponding arm member 83. As a result, regardless of the open/closed state of the arm members 83, the nuts 86 are matched with the axial direction of the left-handed screw and the right-handed screw of the drive shaft 85. At the one end of the grasping drive shaft 85, there is provided a grasping drive pulley 88, which is connected to a grasping motor pulley 90 by a drive belt 89. The grasping drive pulley 90 is driven by a grasping drive motor 91. In order that it may not move in the lateral direction but move in the expanding/contracting direction during the opening/closing operation, the arm shaft 84 is mounted to the arm unit support plate 78 by means of an elongated hole 92 extending in the expanding/contracting direction. As a result, when the pair of arm members 83 move toward and away from each other, the right and left attitude correction shafts 87 make relative rotation with respect to the arm members 83, and, while the arm shaft 84 moves its axis in the expanding/contracting direction, grasping members 93 mounted to the forward ends of the arm members 83 grasp or release the vial 1.

Further, an auxiliary guide pin 94 is provided substantially parallel to the grasping shaft 85. This guide pin performs auxiliary guide so that the arm members 83 may not be vertically inclined around the arm shaft 84 portion. The range of the vertical inclination can be adjusted by an E-ring fixed to the elongated hole 92 in the expanding/contracting direction. At the forward ends of the arm members 83, there are supported grasping members 93 so as to be rotatable around rotation shafts 95, and are urged by arm urging springs 96 such that the forward ends of the grasping members 93 are urged toward each other. When no vial 1 is being grasped, the rear ends of the grasping members 93 are in contact with the wall surfaces of the arm members 83. When the vial 1 is grasped, the rear ends of the grasping members 93 are separated from the surface portions of the arm support portions, and can hold the vial 1 by virtue of the urging force of the arm urging springs 96.

In the robot arm 71, the nuts 86 of the left-handed screw and the right-handed screw provided on the grasping drive shaft 85 are supported by the right and left attitude correction shafts 87, and are constructed to be supported by the arm shaft 84, so the robot arm 71 can be produced at lower cost than the slide unit. Further, in the support by the arm shaft 84 alone, grasping operation is effected along the arc during the grasping operation of the grasping members 93. However, the grasping members 93 support the nuts 86 of the left-handed screw and the right-handed screw provided on the grasping drive shaft 85 by the right and left attitude correction shafts 87. As a result, the arm 84 moves along the elongated hole 92 extending in the expanding/contracting direction, and the grasping embers 93 move to the right and left substantially linearly.

FIG. 11 shows a front outward view of the cap supply unit 100. In the cap supply unit 100, a large cap supply unit 100*a* and a small cap supply unit 100*b* are arranged horizontally adjacent to each other. A large cap introduction duct 101 is mounted to the left-hand side as shown in the drawing of the large cap supply unit 100*a*. The large cap introduction duct 101 extends to a front side from an introduction port 101*a* formed in the left-hand wall of the large cap supply unit 100*a*, and a front opening 101*b* thereof is opposed to the door 28. A small cap introduction duct 102 is mounted to the front side of the small cap supply unit 100*b*. The small cap introduction duct 102 is formed integrally with a cover 103 of the small cap supply unit 100*b*, and extends to the left from an introduction port 102 a formed in the cover 103. The small cap further extends to the front side from the left-hand side of the large cap supply unit 100*a* beyond the front side of the large cap supply unit 100*a*, with an opening 102*b* of the front side thereof being opposed to the door 28. FIG. 12 shows a state where the small cap installation duct 102 is removed. The large cap supply unit 100*a* and the small cap supply unit 100*b* are of the same construction except for the cap introduction ducts 101, 102. Therefore, in the following, a description will be given without distinguishing them from each other.

FIG. 13 shows a side view of the cap supply unit 100. The cap supply unit 100 is composed of a cap accommodating portion 104, a discharge unit 105, and an agitation unit 106.

The accommodating portion 104 is a rectangular box-shaped container accommodating at random a large number of caps charged through the cap introduction duct 101, 102.

The discharge unit 105 has an endless belt 108 stretched between two rollers 107*a*, 107*b* from the rear side wall to the bottom wall of the accommodating portion 104, with support members 109 being provided at fixed intervals in the endless belt 108. The endless belt 108 is composed of a vertical portion 108*a* and an inclined portion 108*b* extending obliquely downwards from the lower end of the vertical portion 108*a*. Between the vertical portion 108*a* and the inclined portion 108*b* of the endless belt 108, a tension roller 110 is held in contact with the back side of the endless belt from the inside. By driving the upper roller 108*a* by a motor 111 via gears 111*a*, 112, the front side of the endless belt 108 ascends obliquely upwards from the lower end, and further ascends in the vertical direction to be turned back at the upper end. As shown in FIG. 14, the support members 109 protrude from the endless belt in a dimension somewhat larger than the thickness of the cap 2, and a cutout 109*a* is formed at the center of each support member so that the cap 2 may be supported in a stable manner. As shown in the upper portion of FIG. 15, when the opening of the cap 2 is directed to the side opposite to the endless belt 108, the cap 2 can be supported by the support members 109 in a stable manner, while, as shown in the lower portion of FIG. 15, when the opening of the cap 2 is opposed to the endless belt 108, the cap is detached from the support member 109. This is because the center of gravity of the vertically set cap 2 is not at the center of the thickness of the cap 2 but on the side opposite to the opening, that is, on the closed side.

In the vicinity of the upper end of the endless belt of the discharge unit 105, there are provided a detection lever which operates when the cap 2 supported by the support member 109 is turned back, and a sensor 114 which is turned on and off according to the operation of the detection lever 113.

Behind the discharge unit 105, there is formed a discharge path 115 so as to be parallel to the vertical portion 108*a* of the endless belt 108. The discharge path 115 receives the cap 2 having been conveyed by the discharge unit 105 to reach the turn-back portion at the upper end, and guides it downwards. At the upper end of the discharge path 115, there is provided a guide plate 116 for guiding the cap 2 to the discharge path 115.

The agitation unit 106 has an agitation plate 118 provided so as to be capable of vertically reciprocating along the inner side wall of the accommodating portion 104 by means of a plurality of guides 117. In the lower portion of the agitation plate 118, a plurality of lock holes 118*a* to which the caps 2 accommodated in the accommodating portion 104 are locked and which extend in the horizontal direction are formed at fixed intervals in the vertical direction. Instead of forming the lock holes 118*a* of the agitation plate 118 as holes, it is also possible to form them as protrusions. The lock holes 118*a* are preferable in that they do not decrease the capacity of the accommodating portion 104. In the side edge of the upper portion of the agitation plate 118, there is formed a cutout 118*b*; a roller 121 at the forward end of a cam 120 provided integrally with a gear 119 in mesh with the drive gear 111*a* of the motor 111 of the discharge unit 105 abuts the upper side edge of the cutout 118*b*. As a result, the agitation plate is interlocked with the endless belt 108 of the discharge unit 105 and periodically reciprocates in the vertical direction.

Next, the operation of the vial capping device will be described.

FIGS. 16A through 16F show side views of the cap installation unit 31 and the robot arm 71, illustrating the operation of the robot arm 71. The robot arm 71 moves the vial 1 from the delivery position to the cap installation unit 31. After the cap installation unit 31 tightens the cap 2, the robot arm 71 further moves the vial 1 to the vial discharge portion 6.

FIG. 16A shows the state in which the robot arm 71 is at the vial delivery position, with the robot arm 71 reaching a position near the slide limit through expansion of the slide rail. For enabling to adjust this position, a pulse motor may be adopted as the expansion/contraction drive motor 81, effecting feedback by an encoder or effecting stop by a position detecting sensor. When the position of the grasping members 93 at the forward end of the arm is matched with vial delivery position, the grasping drive motor 91 is driven. Then, the grasping drive pulley 90 rotates and force generated therefrom is transmitted through the drive belt 89 to rotate the grasping drive pulley 88, and this rotation causes the grasping drive shaft 85 supported by a bearing to rotate. When the grasping drive shaft 85 rotates, the right and left screws rotate, and the two nuts 86 threadedly engaged with the left-handed screw and the right-handed screw are brought close to each other. As a result, the pair of arm members 83 are brought close to each other, and the grasping members 93 at the forward end grasps the vial 1. Programming is effected such that, at this time, when the operation of the drive motor 91 is continued while the urging force and the repulsive force of the arm urging springs 96 are balanced, the electric current value increases upon reception of the repulsive force of the arm urging springs 96, the operation being stopped when a preset electric current value is exceeded. This means that, even if vials 1 of different diameters are used together, it is possible to grasp the vials with a fixed grasping force. That is, there is advantage of no need to set the control and the detecting portion in conformity with the kind of vial 1.

When the robot arm 71 grasps the vial 1, a robot arm ascent/descent motor (not shown) is driven to raise the robot arm along the rail members 73. Subsequently, the expansion/contraction drive motor 81 is rotated to contract the arm unit support plate 78 along the slide rail. In the example shown in the drawing, the vial 1 being grasped is of a large diameter, so the expansion contraction motor 81 is stopped when the vial reaches the cap supply portion 33 directly below the cap installation ring 35 of the cap installation unit 31, which maches the large diameter caps 2. The robot arm ascent/descent motor (not shown) is stopped when the standby position shown in FIG. 16B is reached, and cap tightening will be started.

FIG. 16B shows a process in which the motor bracket 37 is lowered by the screw of the ascent/descent drive shaft 47 to lower the cap installation unit 31 while rotating the cap rotating motor 42. While the cap installation ring 35 rotates, the cap 2 prepared at the cap supply portion 33 stops due to the frictional force between it and the L-shaped guides 34 under the depression pressure of the cap installation ring 35, and the ring inner periphery thread 56 of the cap installation ring 35 is threadedly engaged with the cap outer periphery thread 9 of the cap 2.

When the cap installation ring 35 is lowered to a predetermined height, the cap 2 is completely threadedly engaged with the cap installation ring 35 as shown in FIG. 16C, and here, the cap setting torque limiter 41*a* operates. In this stage, the L-shaped guides 34 are opened as shown in FIG. 7B, and the robot arm 71 is raised from the standby position to the closing position. The cap 2 threadedly engaged with the cap installation ring 35 rotates together with the cap installation ring 35, and the cap inner periphery thread 6 of the cap 2 is threadedly engaged with the vial outer periphery thread 4 of the vial 1. Here, the torque limiter 41*a* operates to prevent excessive tightening of the cap 2. When the cap inner periphery thread 6 of the cap 2 threadedly engaged with the cap installation ring 35 is threadedly engaged with the outer periphery thread 4 of the vial, the torque of the cap 2 is exerted such that the cap 2 is threadedly engaged with the cap installation ring 35, so the holding of the cap 2 by the cap installation ring 35 is stabilized, making it possible to effect capping reliably with a simple construction.

While in the example described above the robot arm 71 is raised to the closing position, it is also possible to further lower the cap installation unit 31 with the robot arm 71 remaining stationary at the standby position and capping the vial, or to bring both units close to each other.

When the cap 2 is completely tightened, the operation stops in the state as shown in FIG. 16D. The cap rotating motor 42 is rotated for a fixed period of time, and when a period of time long enough to attain the closed state elapses, the cap rotating motor 42 is rotated in the reverse direction, and the cap installation unit 31 is raised to restore it to the origin as shown in FIG. 16E. At this time, the engagement portion 13 of the cap 2 is engaged with the rotation restricting portion 12 of the vial 1 to prevent rotation of the cap 2, so the threaded engagement of the cap installation ring 35 and the cap 2 is canceled, and the cap 2 is attached to the vial 1. Next, the L-shaped guides 34 are closed, and the robot arm 71 is lowered to the movement position as shown in FIG. 16F, with the capped vial 1 being conveyed to the corresponding one of the vial discharge portions 6 shown in FIG. 1.

A remarkable feature of the present invention is that, before attaching the cap 2 to the vial 1, the cap 2 is firmly held through threaded engagement of the cap outer periphery thread 9 of the cap 2 and the ring inner periphery thread 56 of the cap installation ring 35. While in the above embodiment the cap installation unit 31 is lowered onto the cap 2 on the L-shaped guides 34, it is also possible to provide the L-shaped guides 34 with an ascent/descent means and to press the cap 2 against the cap installation ring 35, or to move both to attach the cap 2 to the cap installation ring 35. Further, while in the above embodiment the cap 2 is rotated when attaching the cap 2 to the vial 1, it is also possible to rotate the vial 1, or to rotate both the vial 1 and the cap 2.

BRIEF DESCRIPTION OF THE DRAWINGS

FIG. 18A is a side view of the conventional vial and the cap.

DESCRIPTION OF REFERENCE NUMERALS

Figure 1:
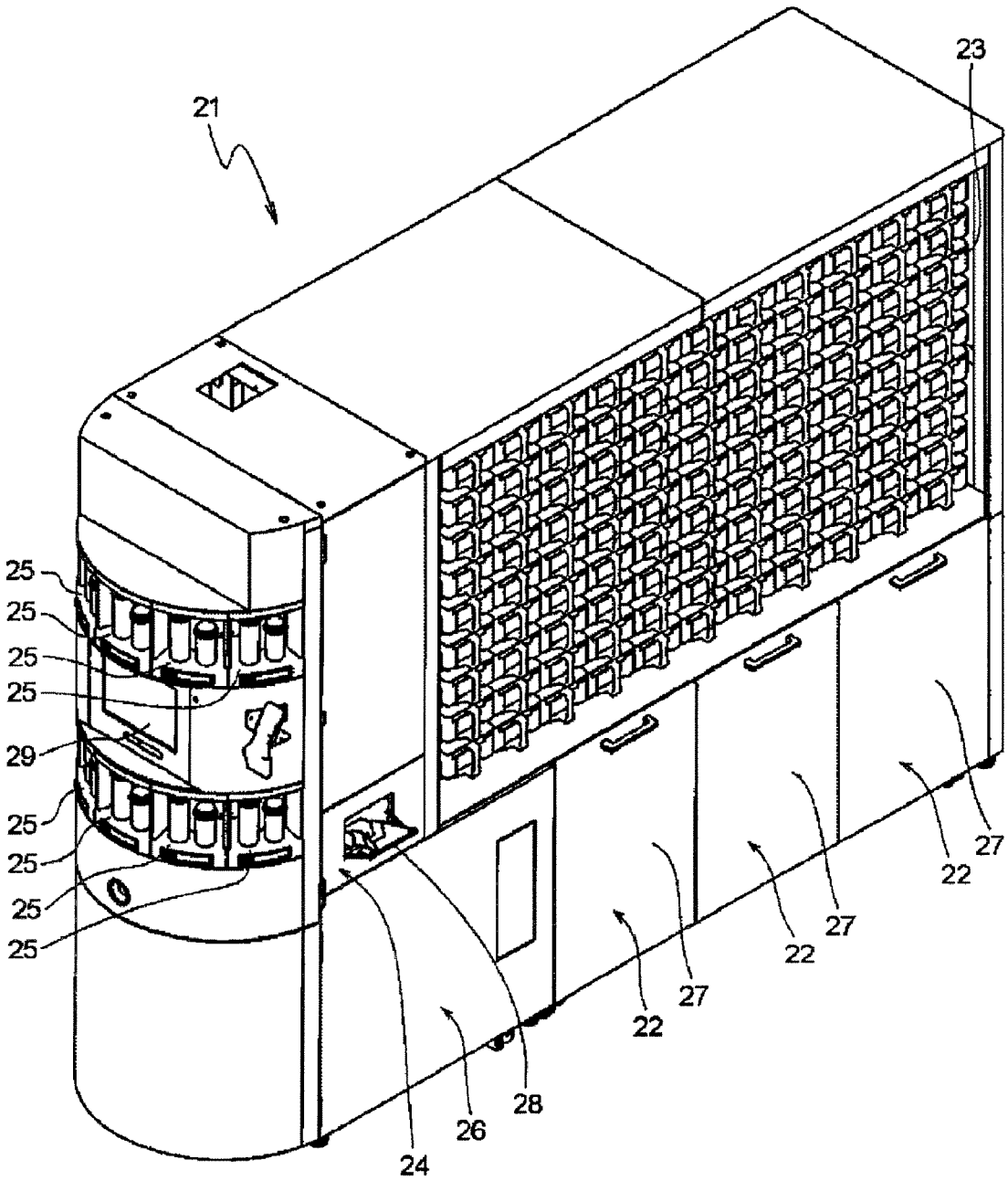
FIG. 1 is a perspective view of a tablet filling device equipped with a vial capping device according to the present invention.
Figure 2:
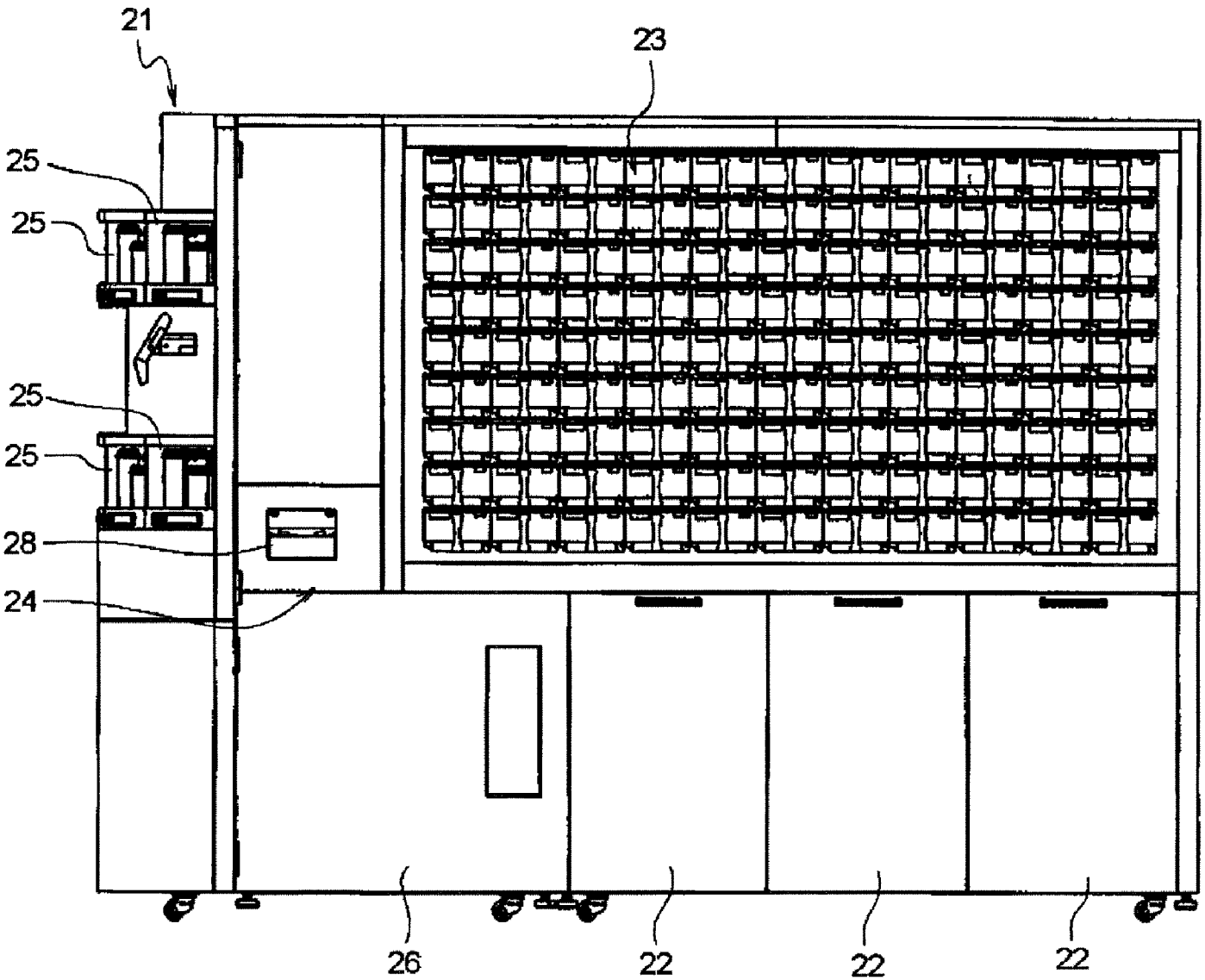
FIG. 2 is a front elevation view of the vial capping device of FIG. 1.
Figure 3:
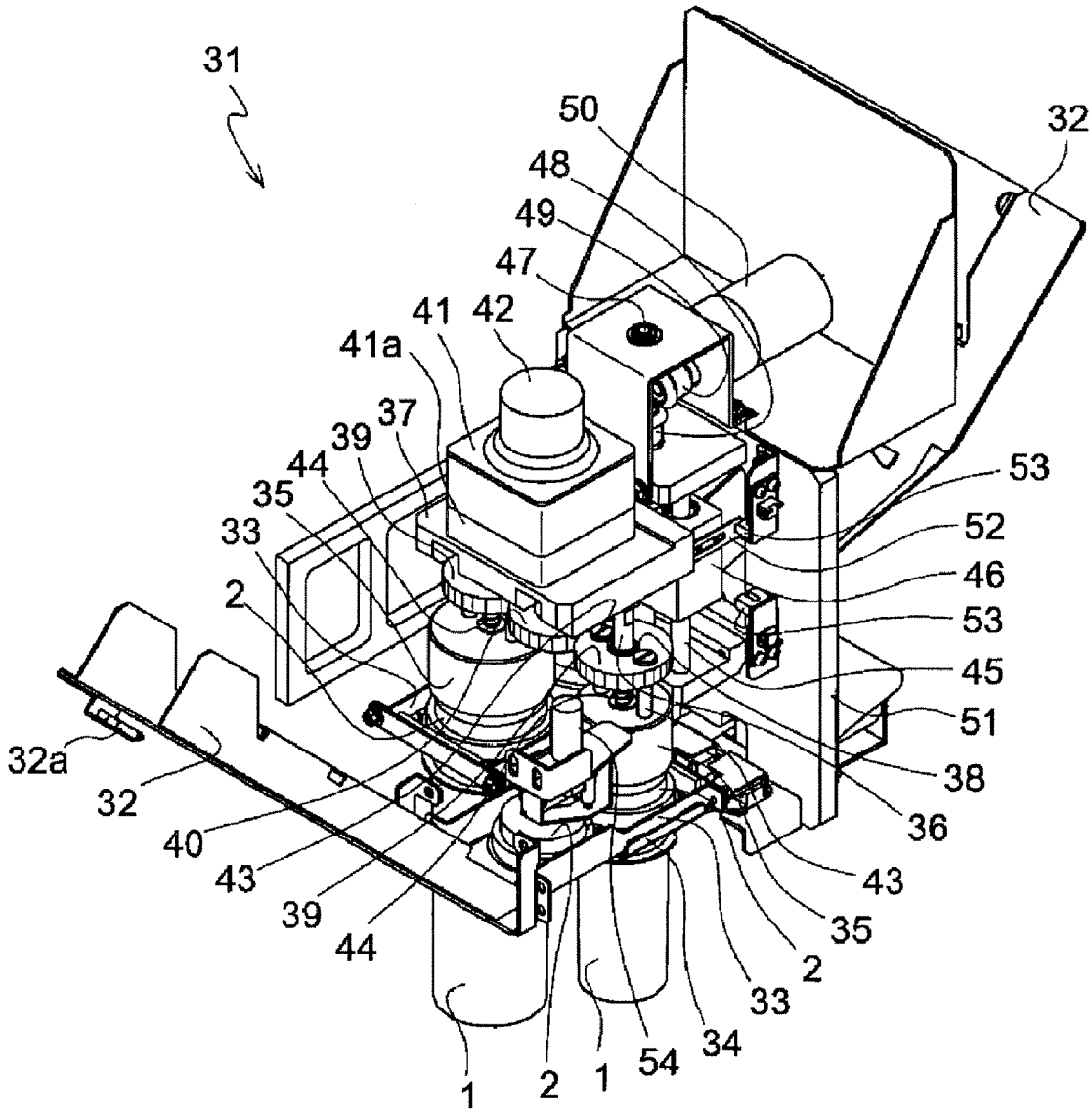
FIG. 3 is a perspective view of the cap installation unit of the vial capping device of the present invention.
Figure 4:
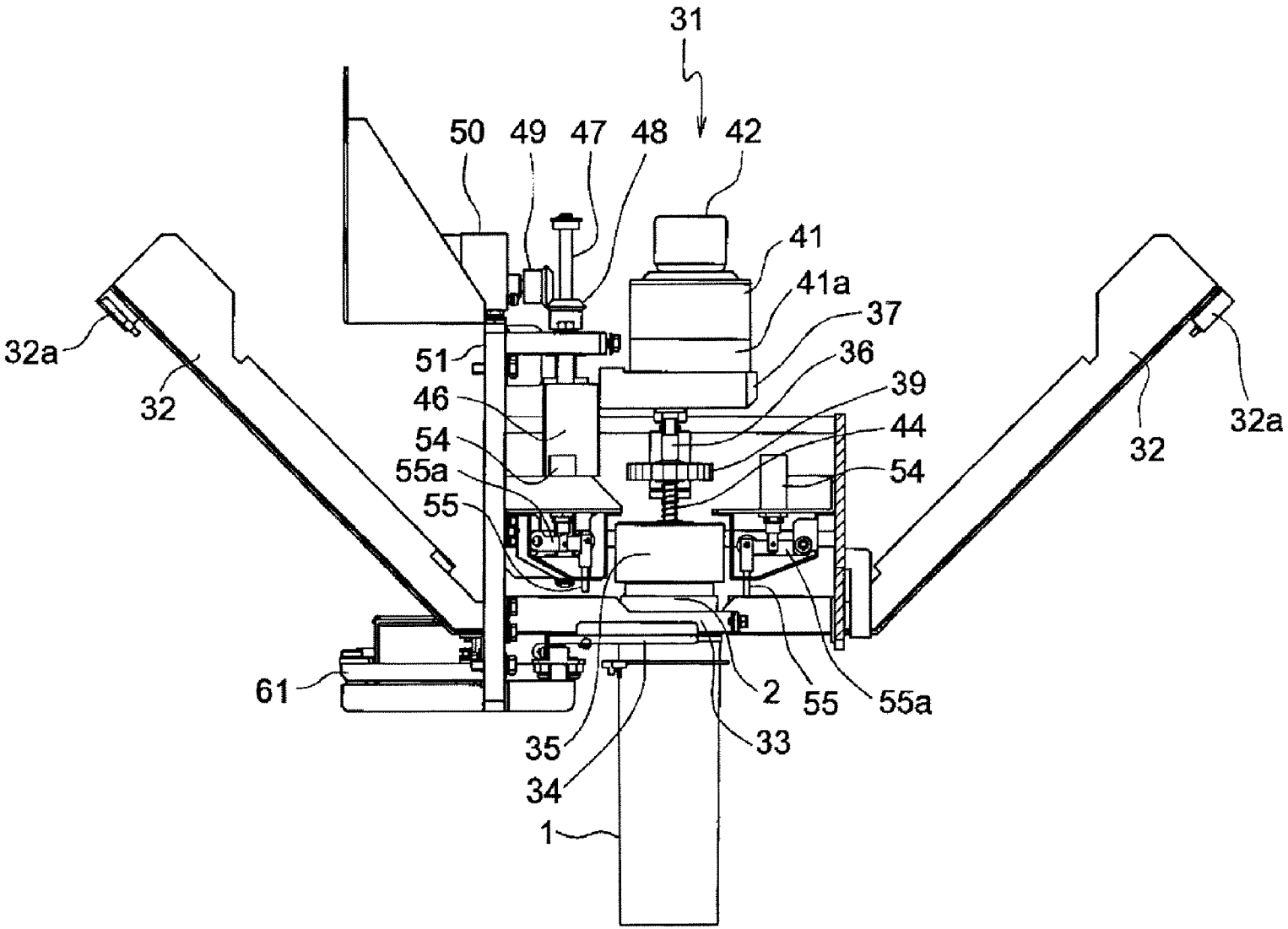
FIG. 4 is a front view of the cap installation unit of FIG. 3.
Figure 5:
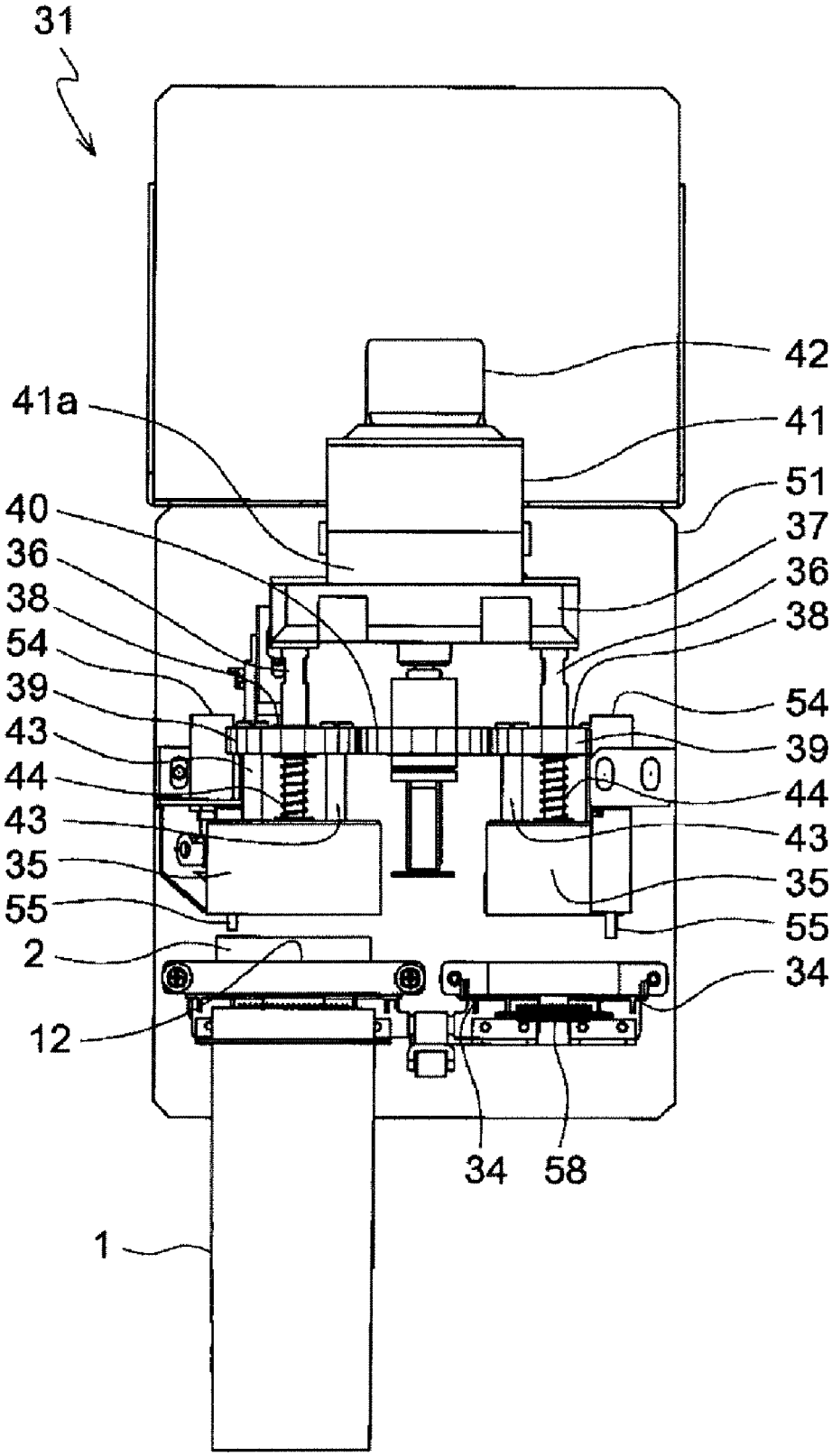
FIG. 5 is a side view of the cap installation unit of FIG. 3.
Figure 6:
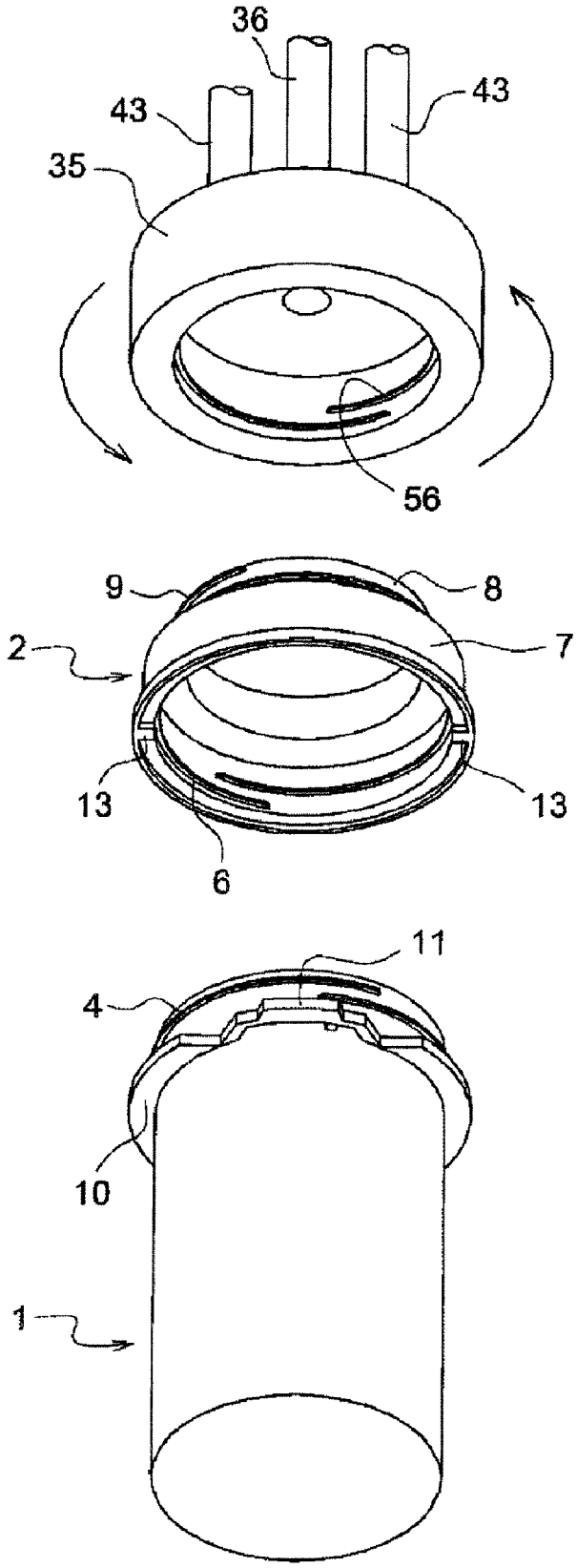
FIG. 6 is a perspective view showing the relationship between the cap installation ring of the cap installation unit and the cap and the vial of FIG. 3.
Figure 7A:
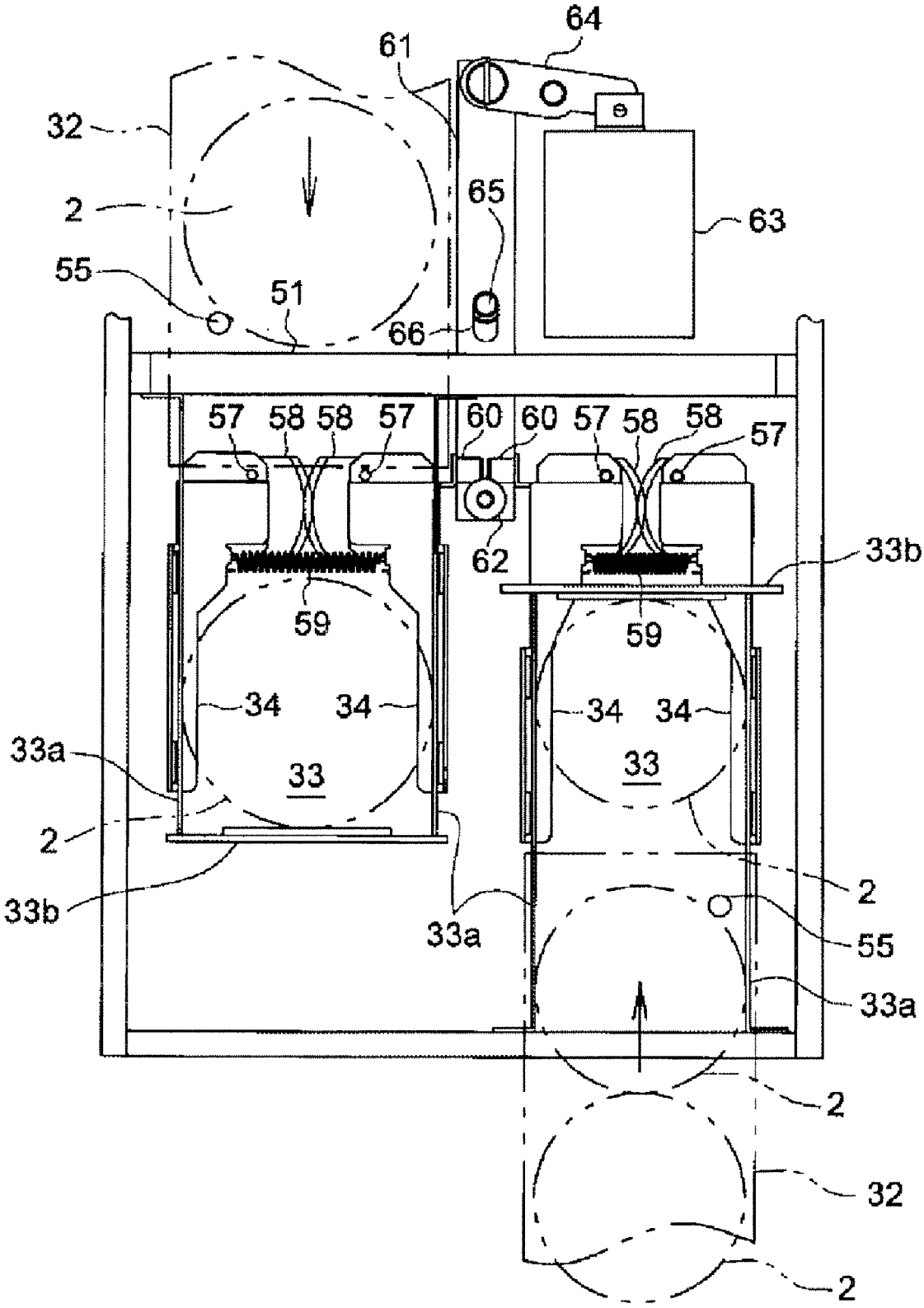
FIG. 7A is a plan view of the L-shaped guides of the cap installation unit of FIG. 3 in the closed state.
Figure 7B:
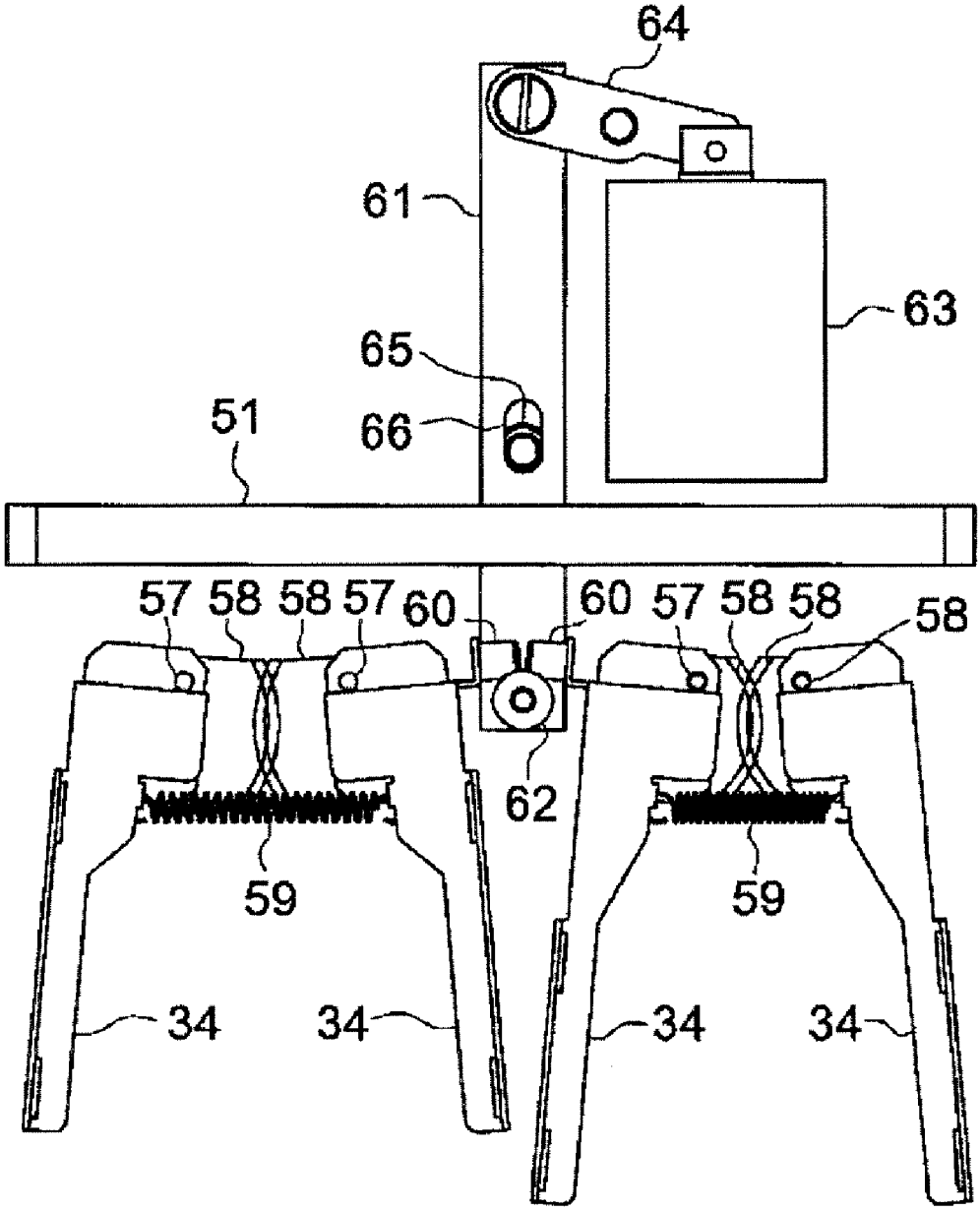
FIG. 7B is a plan view of the L-shaped guides of FIG. 7A in the open state.
Figure 8:
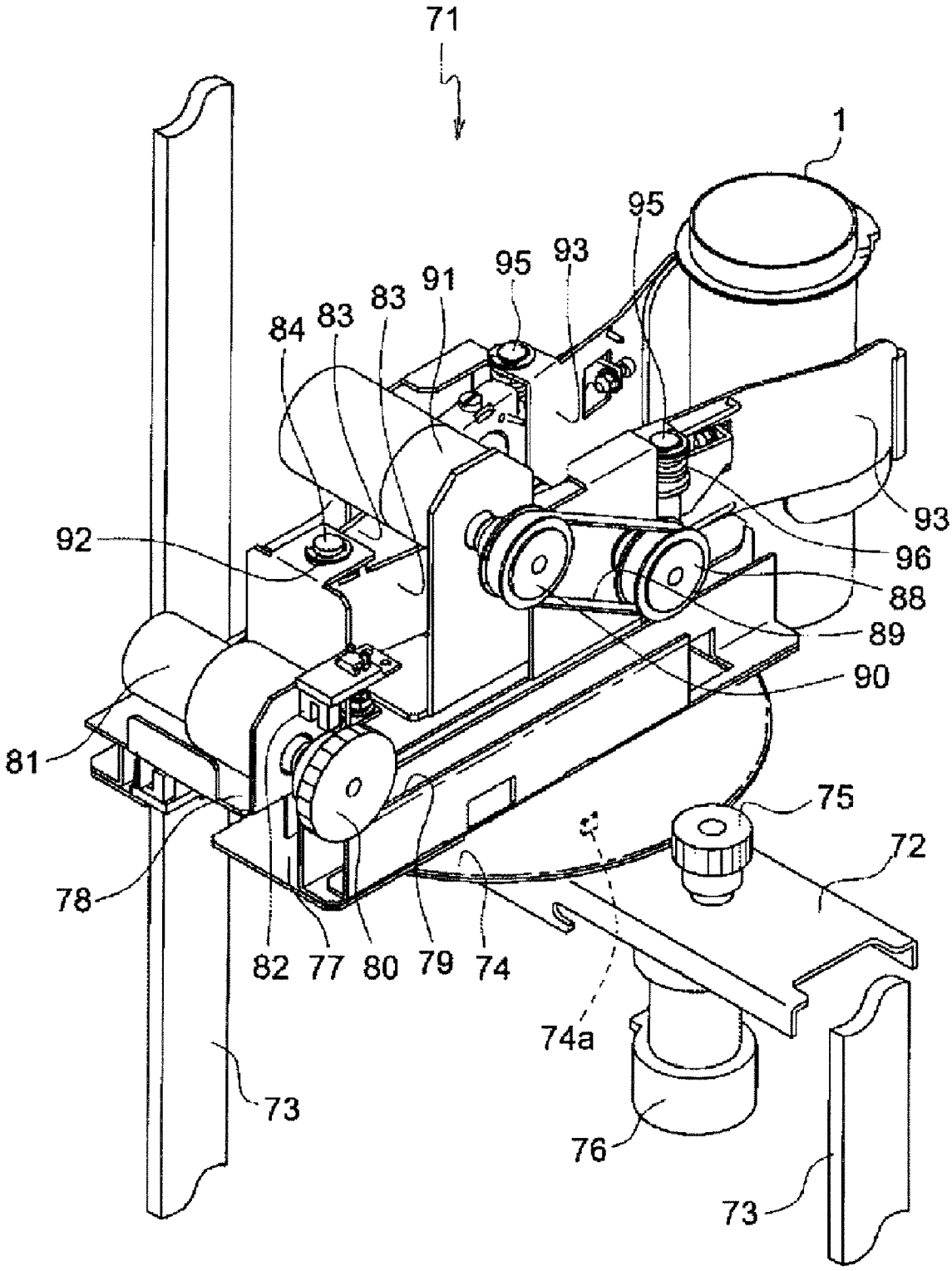
FIG. 8 is a perspective view of the robot arm of the vial capping device of the present invention.
Figure 9A:
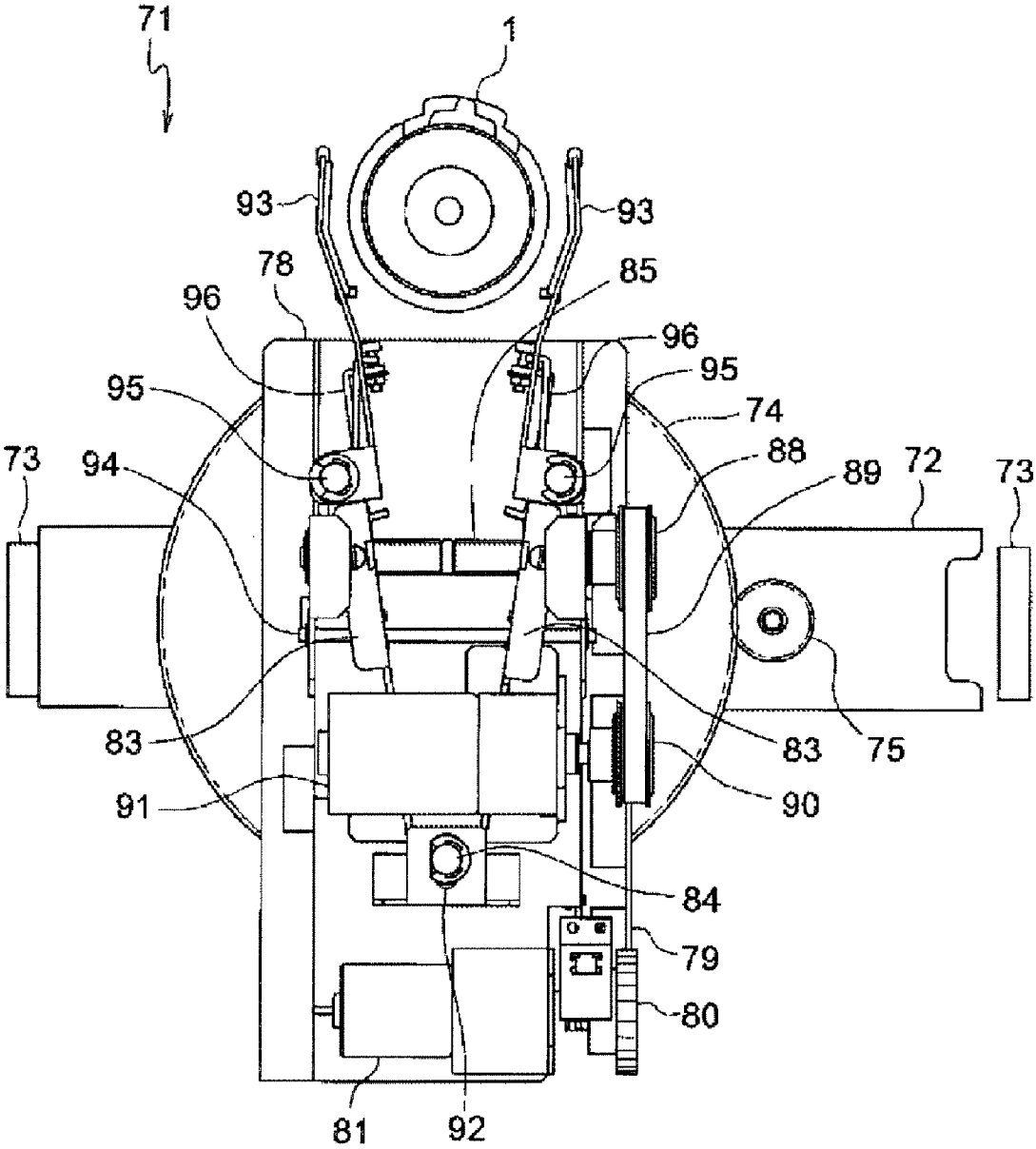
FIG. 9A is a plan view of the robot arm of FIG. 8.
Figure 9B:
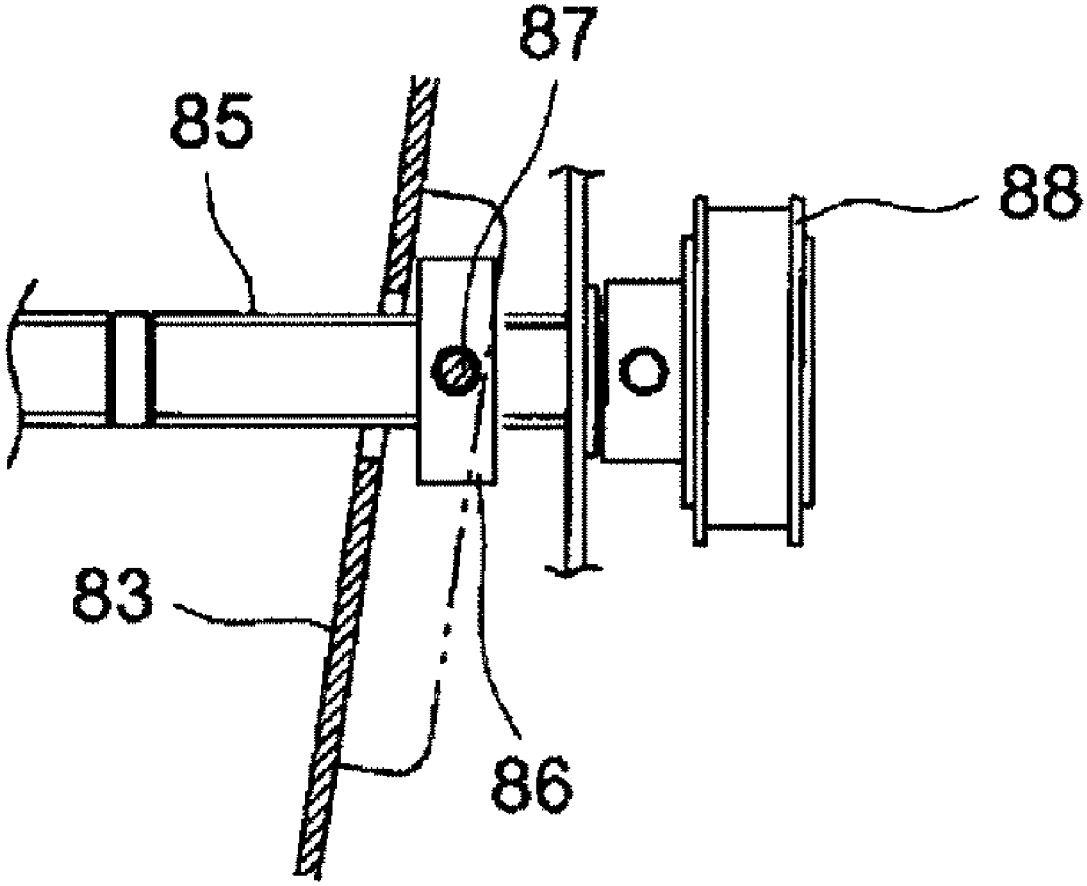
FIG. 9B is a partial enlarged view of the robot arm of FIG. 9A.
Figure 10:
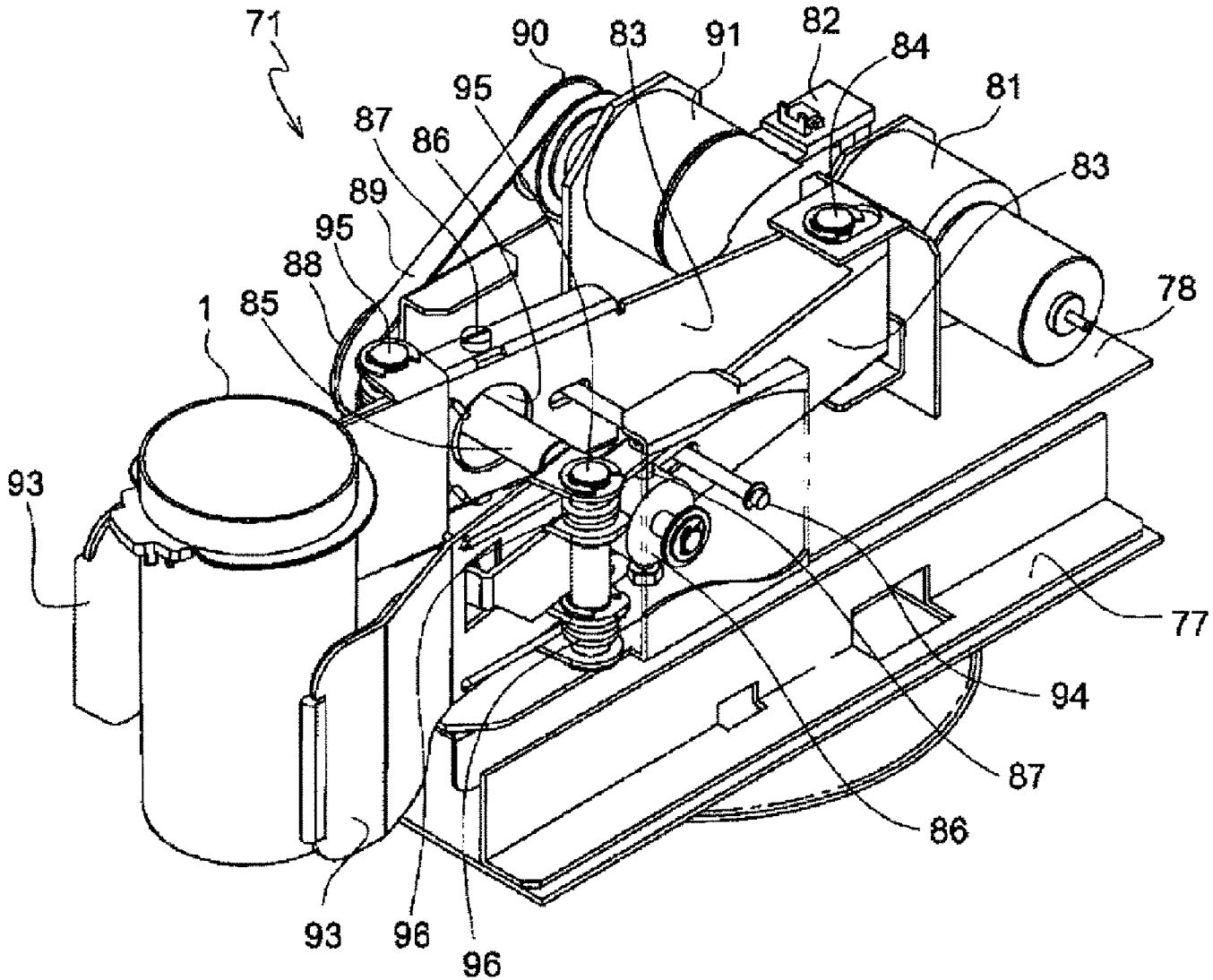
FIG. 10 is a perspective view, as taken in a different direction of the robot arm of FIG. 8.
Figure 11:
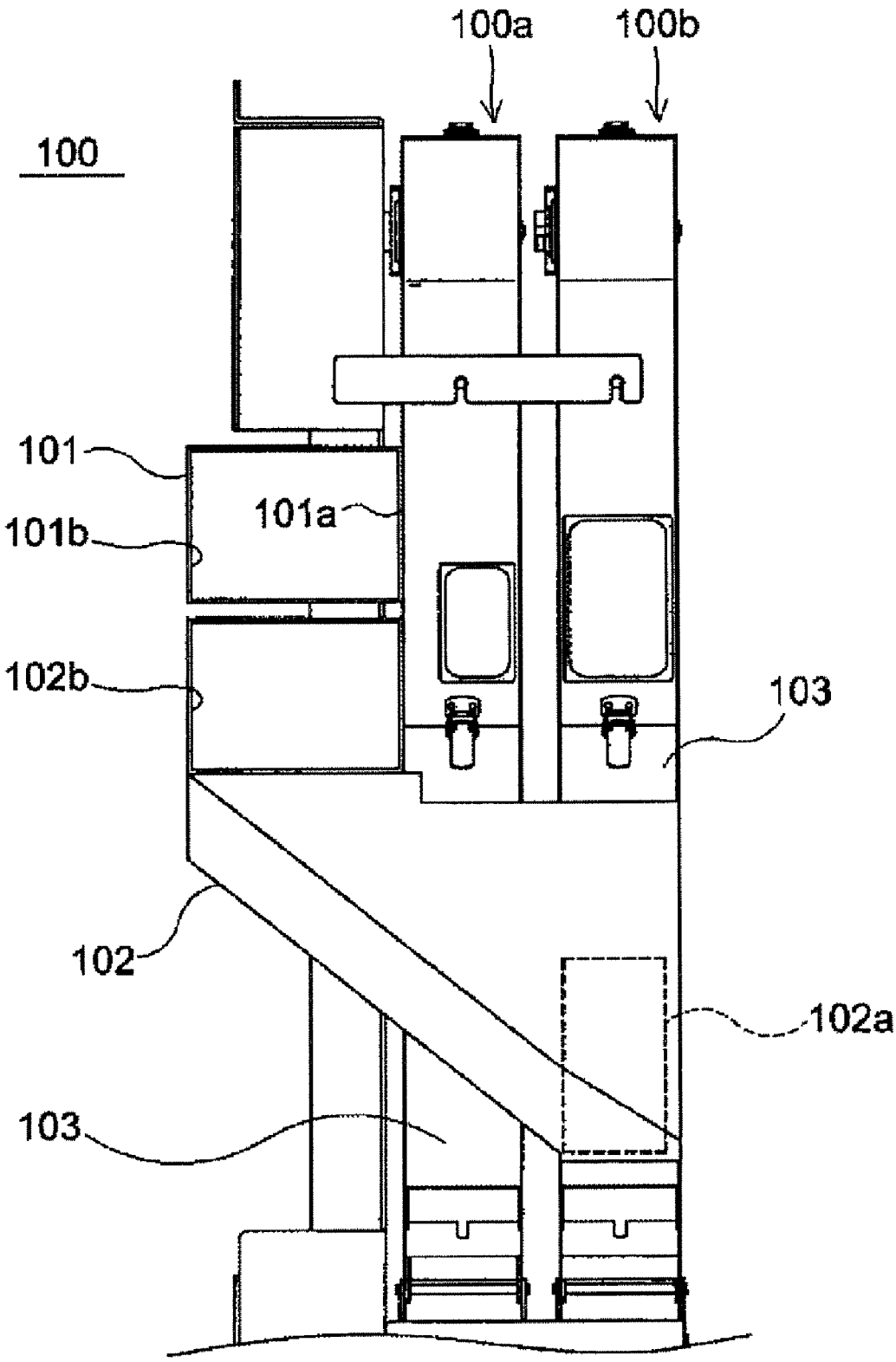
FIG. 11 is a front view of the cap supply unit.
Figure 12:
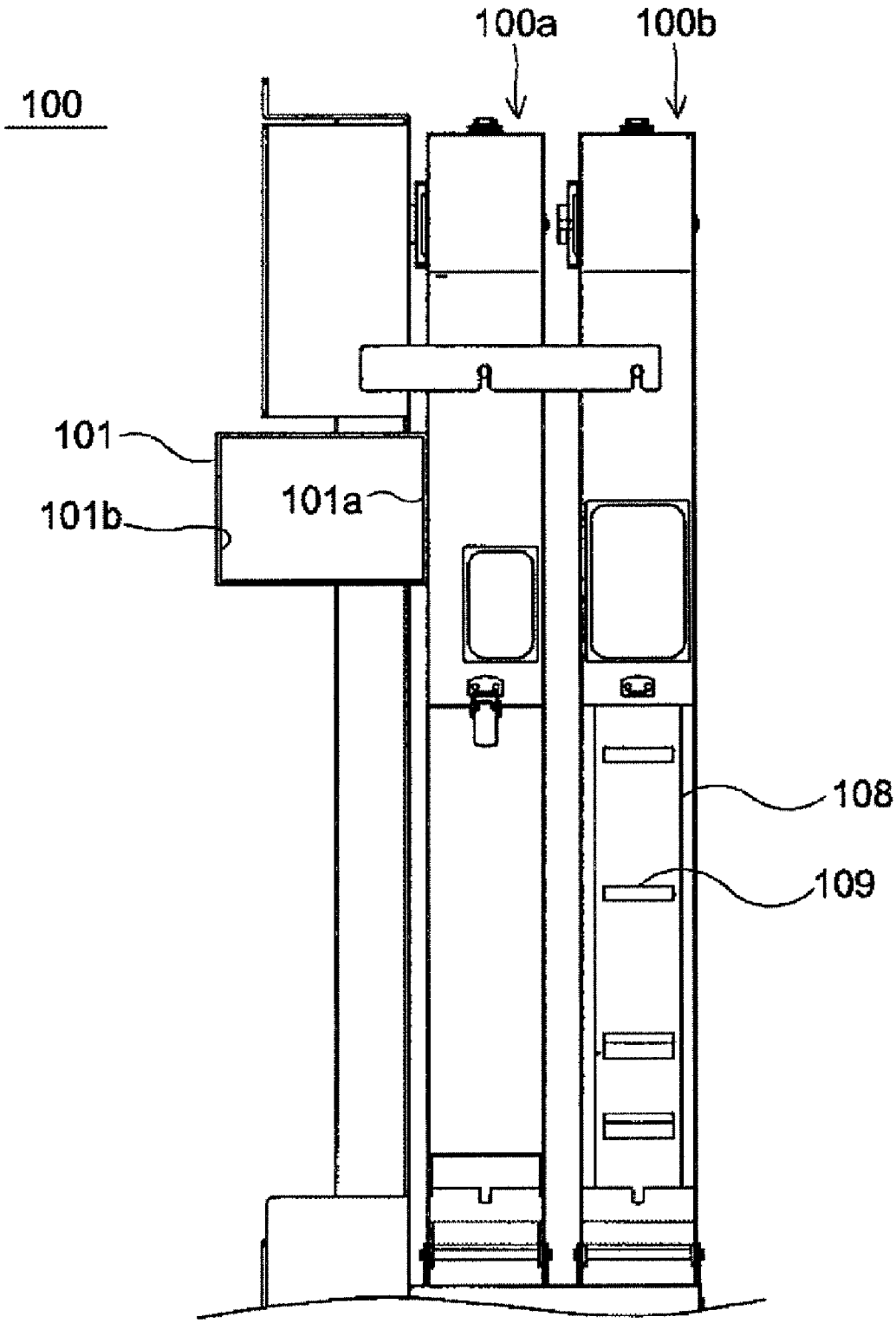
FIG. 12 is a front view of the cap supply unit with the small cap introduction duct removed therefrom.
Figure 13:
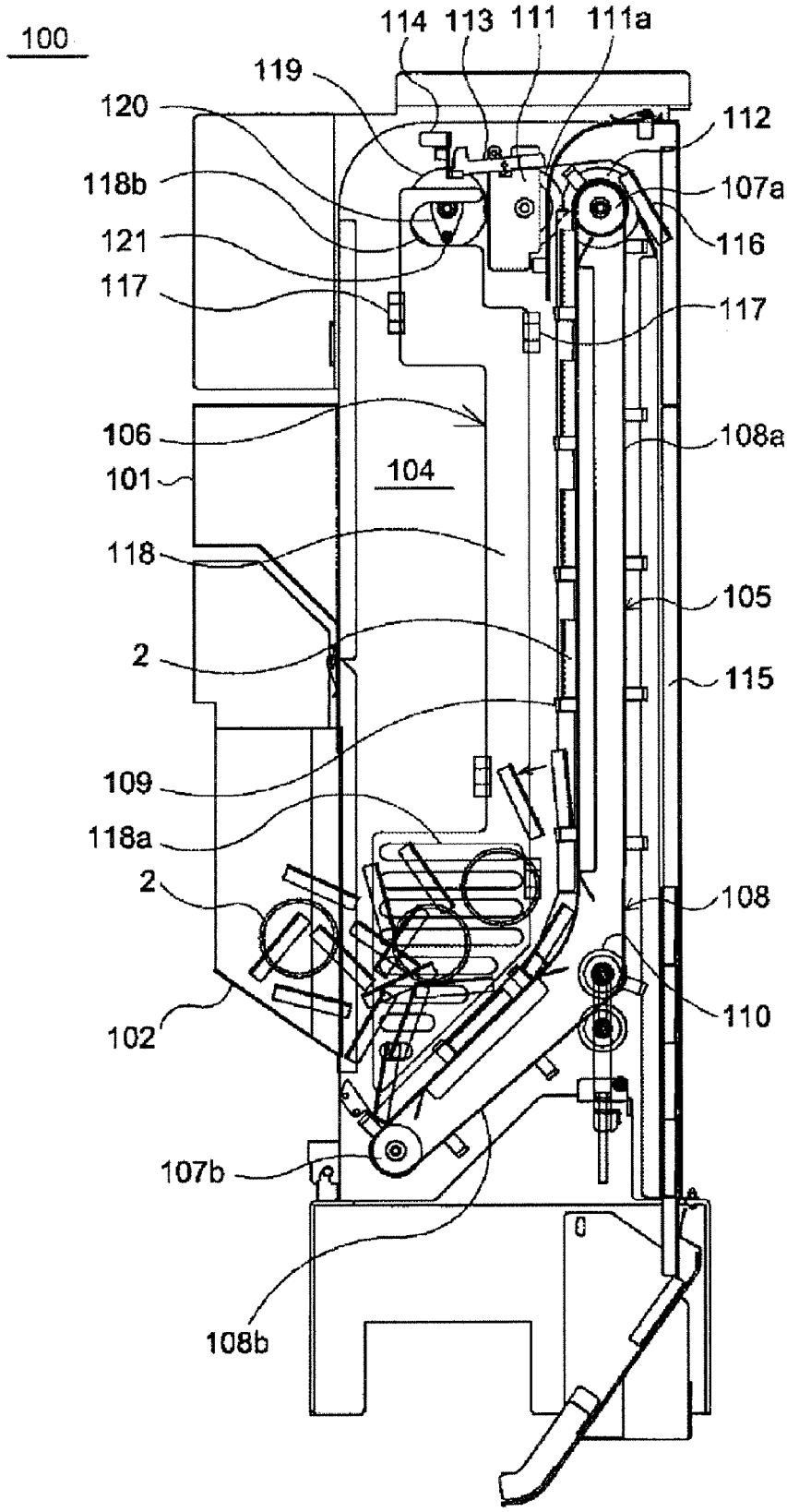
FIG. 13 is a sectional view of the cap supply unit.
Figure 14:
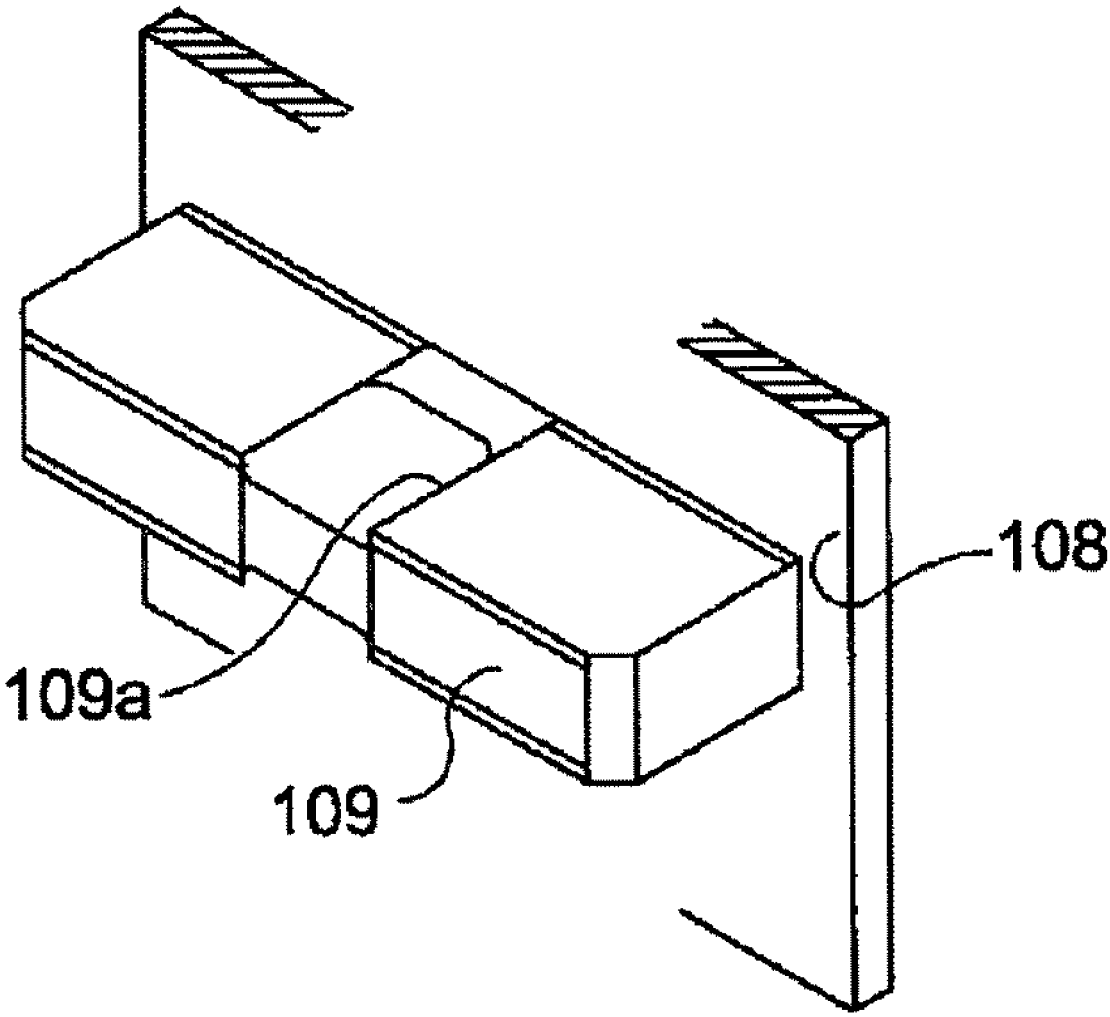
FIG. 14 is a perspective view of a support member of an endless belt.
Figure 15:
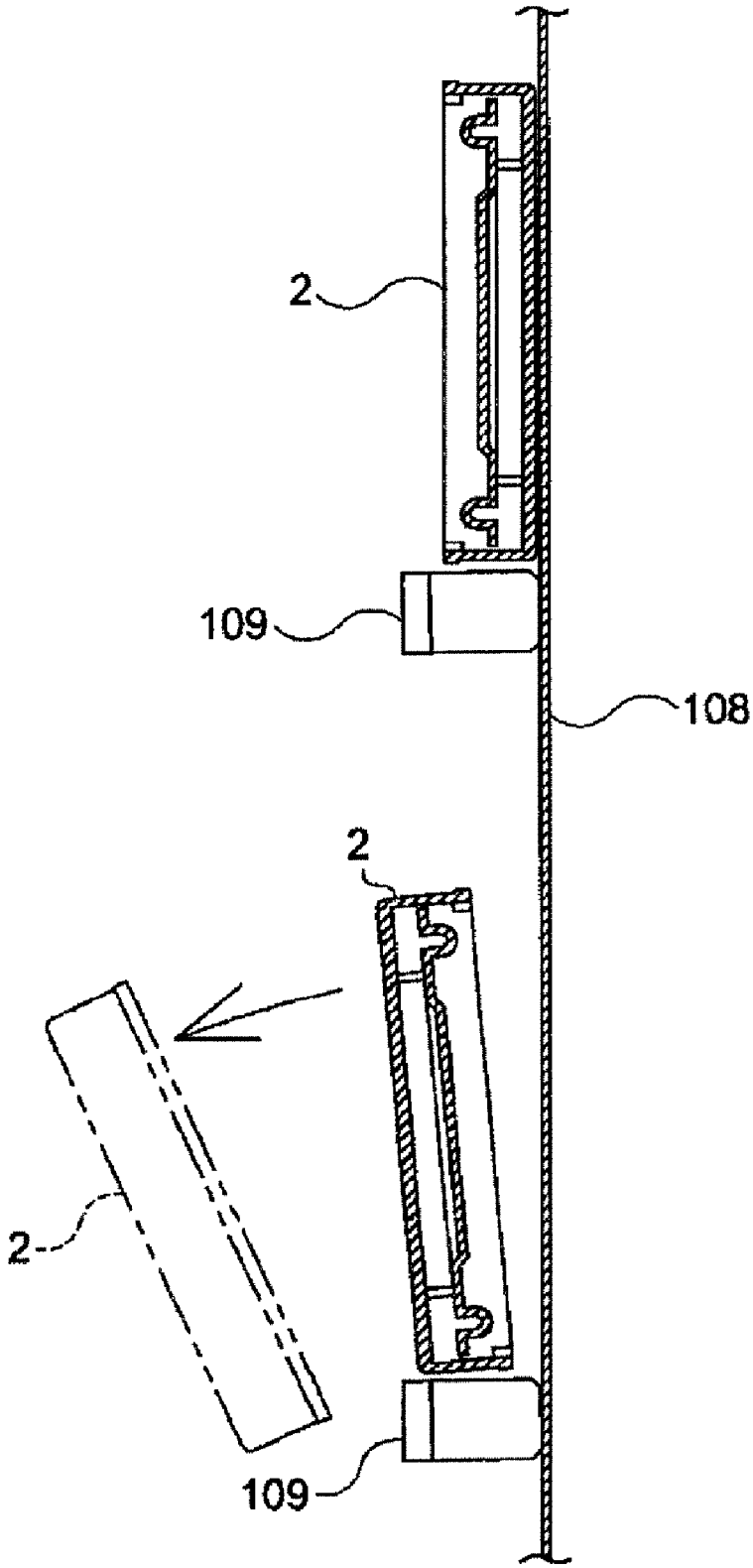
FIG. 15 is a side view showing how caps are supported by support members of the endless belt.
Figure 16A:
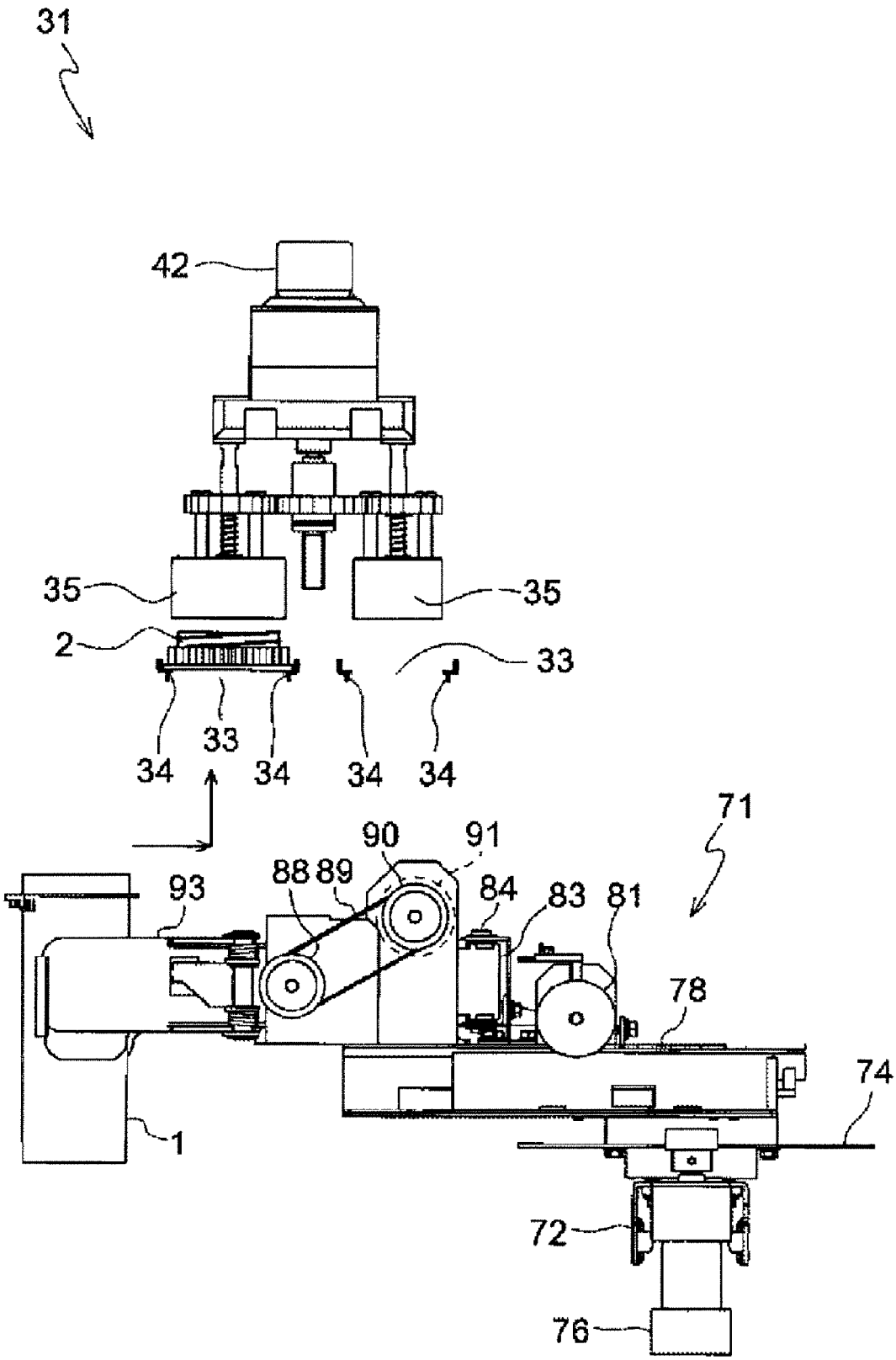
FIG. 16A is a side view showing the positional relationship between the cap installation unit of FIG. 3 and the robot arm of FIG. 8 prior to capping start.
Figure 16B:
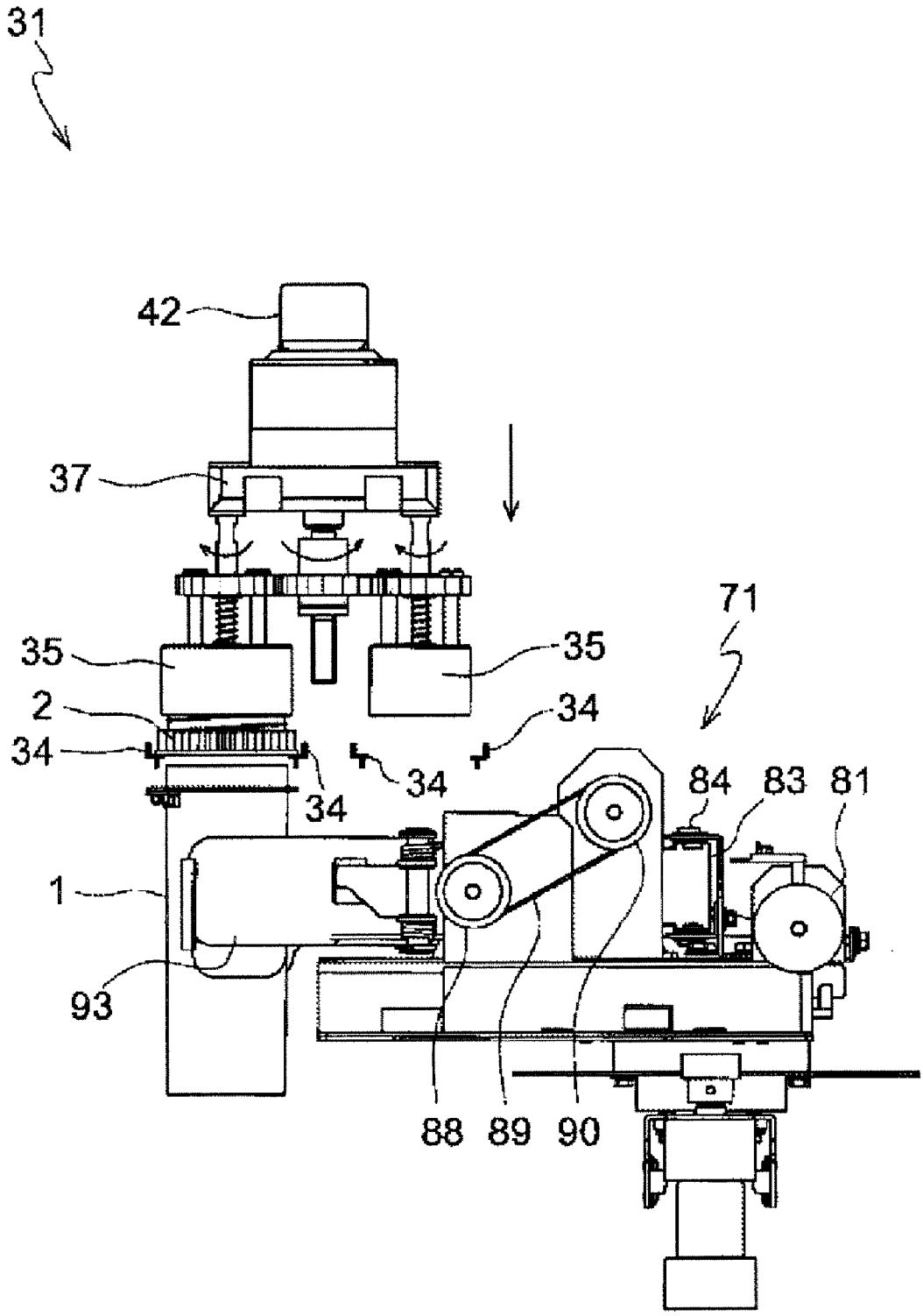
FIG. 16B is a side view showing the positional relationship between the cap installation unit of FIG. 3 and the robot arm of FIG. 8 at the time of capping start.
Figure 16C:
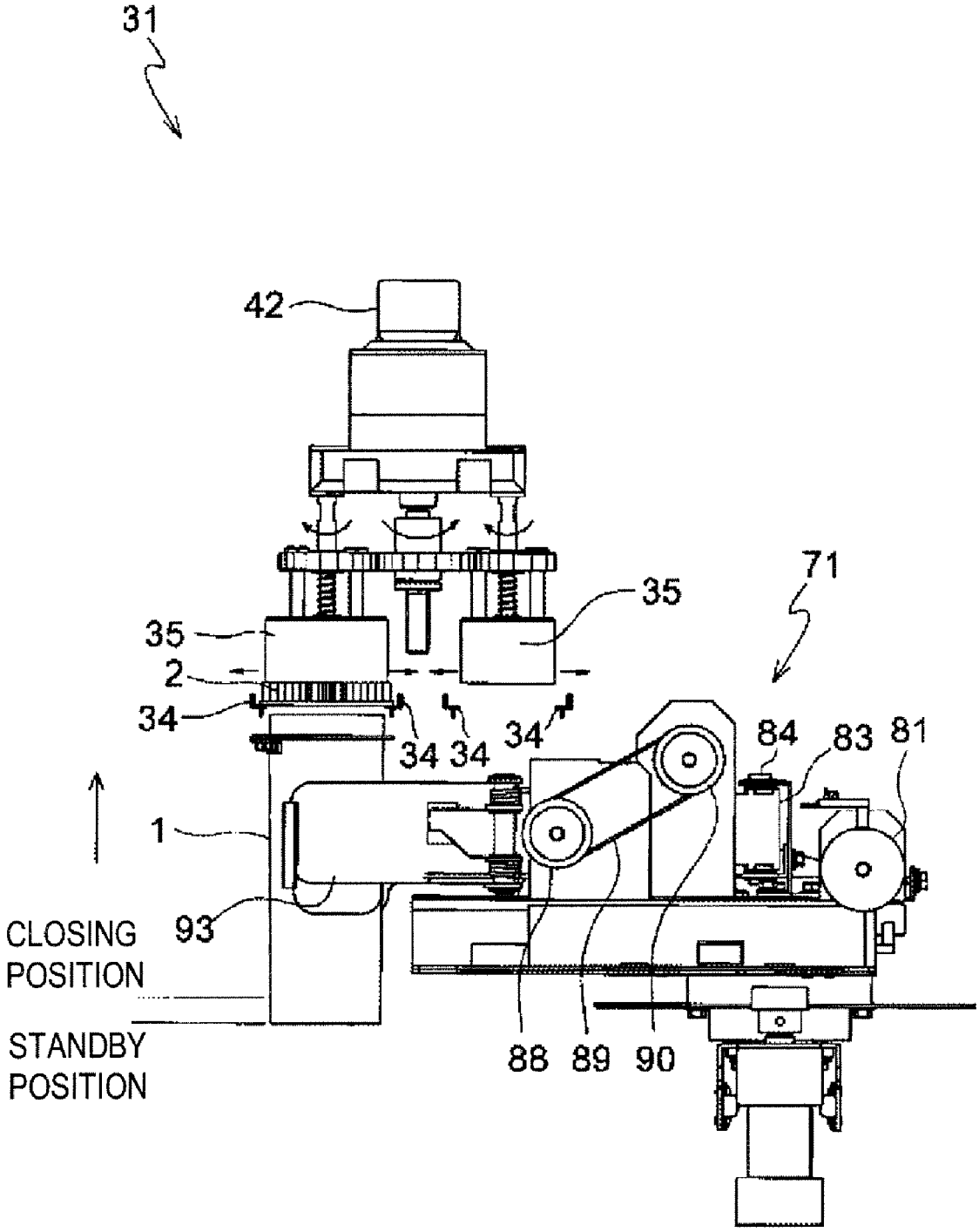
FIG. 16C is a side view showing the positional relationship between the cap installation unit of FIG. 3 and the robot arm of FIG. 8 at the stage next to that of FIG. 16B.
Figure 16D:
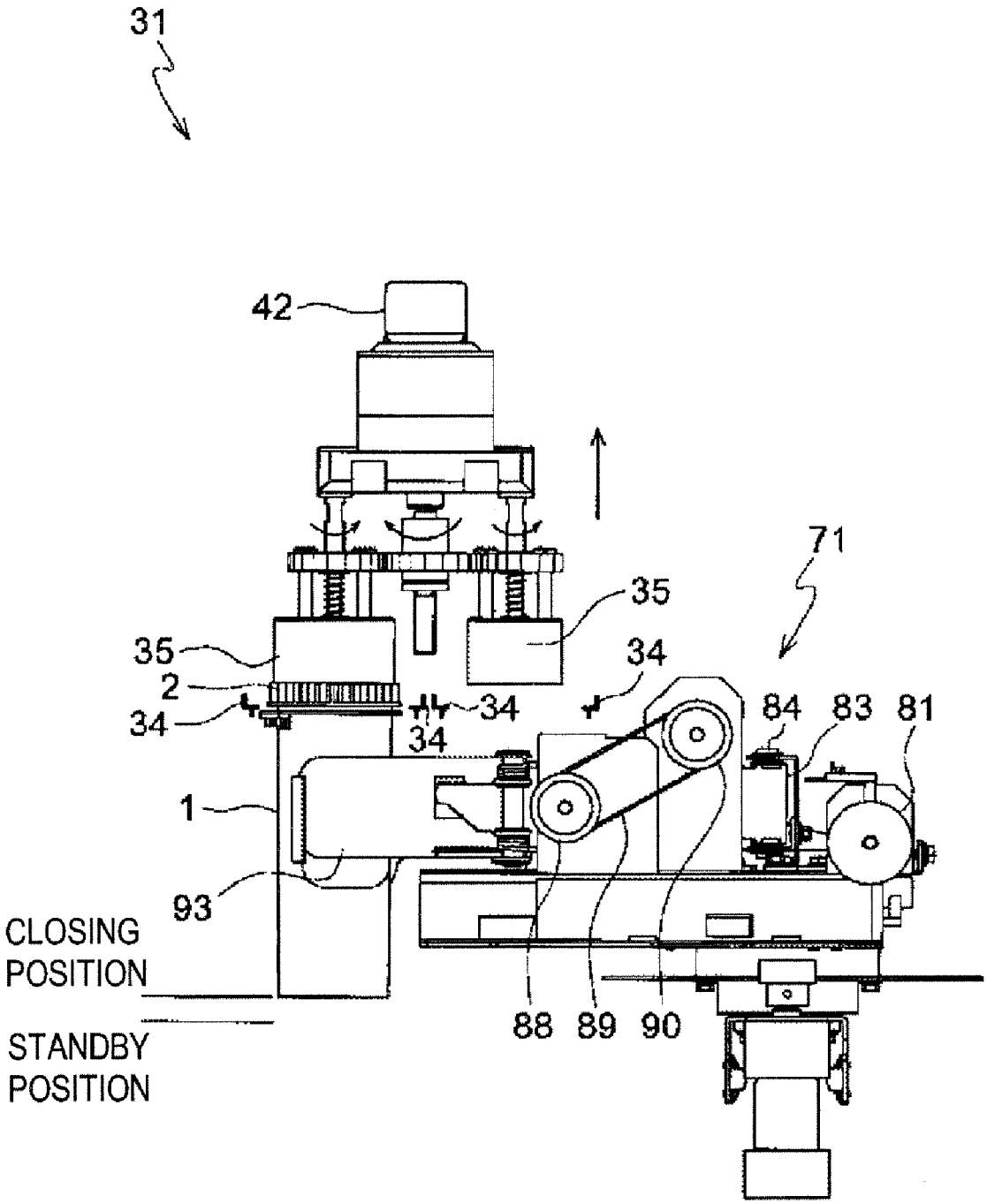
FIG. 16D is a side view showing the positional relationship between the cap installation unit of FIG. 3 and the robot arm of FIG. 8 at the stage next to that of FIG. 16C.
Figure 16E:
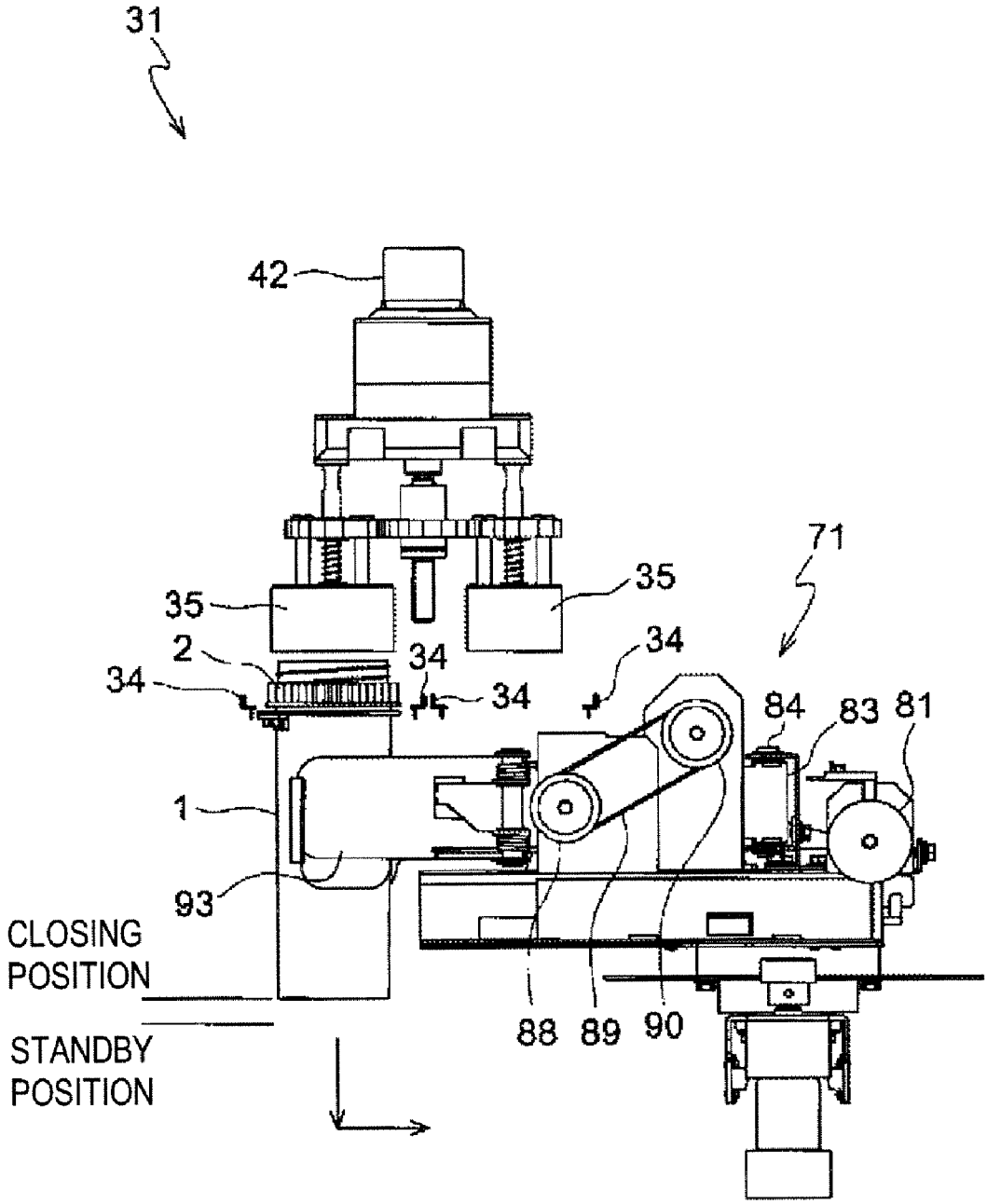
FIG. 16E is a side view showing the positional relationship between the cap installation unit of FIG. 3 and the robot arm of FIG. 8 at the time of the completion of capping.
Figure 16F:
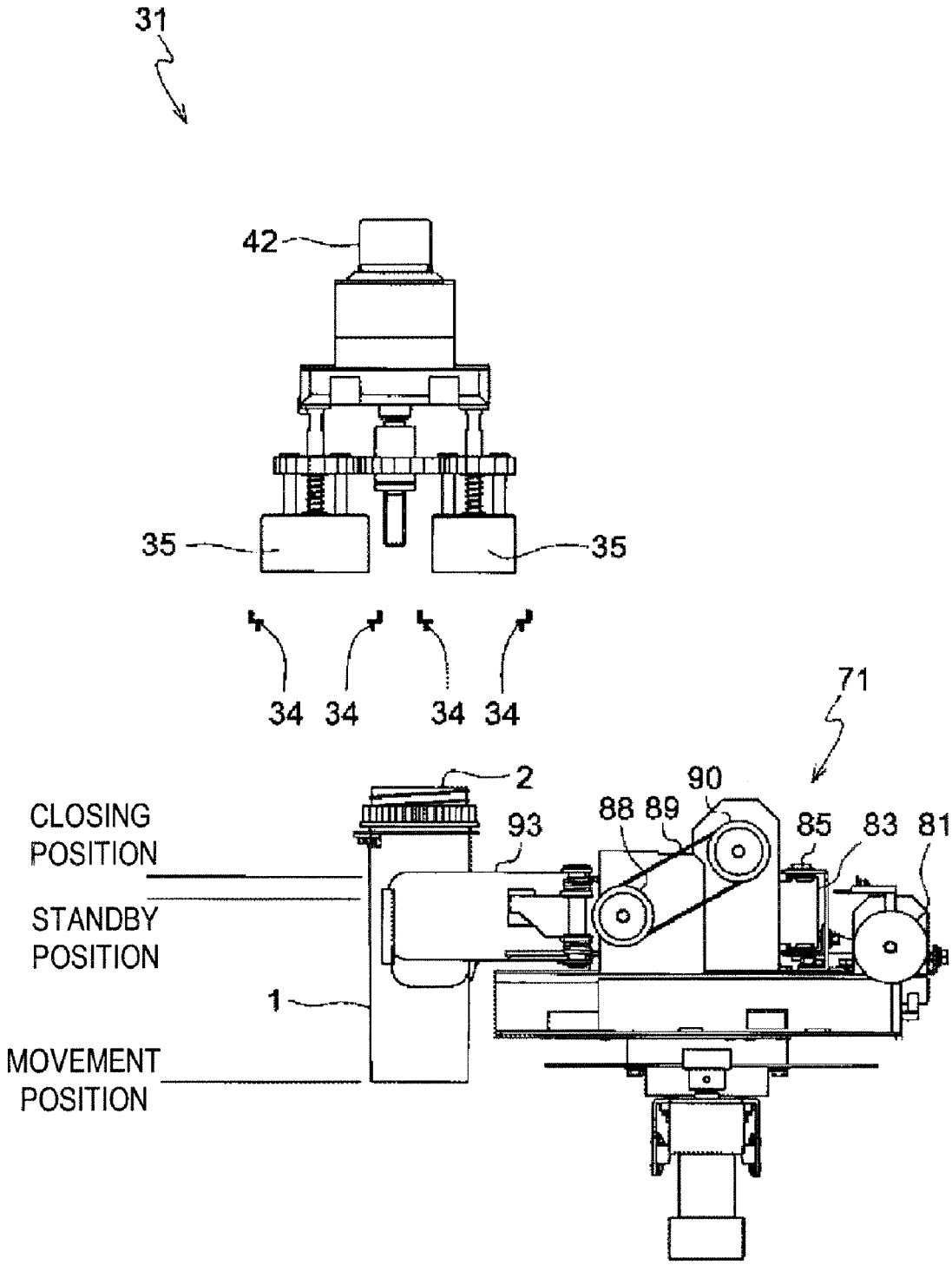
FIG. 16F is a side view showing the positional relationship between the cap installation unit of FIG. 3 and the robot arm of FIG. 8 after the completion of capping.
Figure 17:
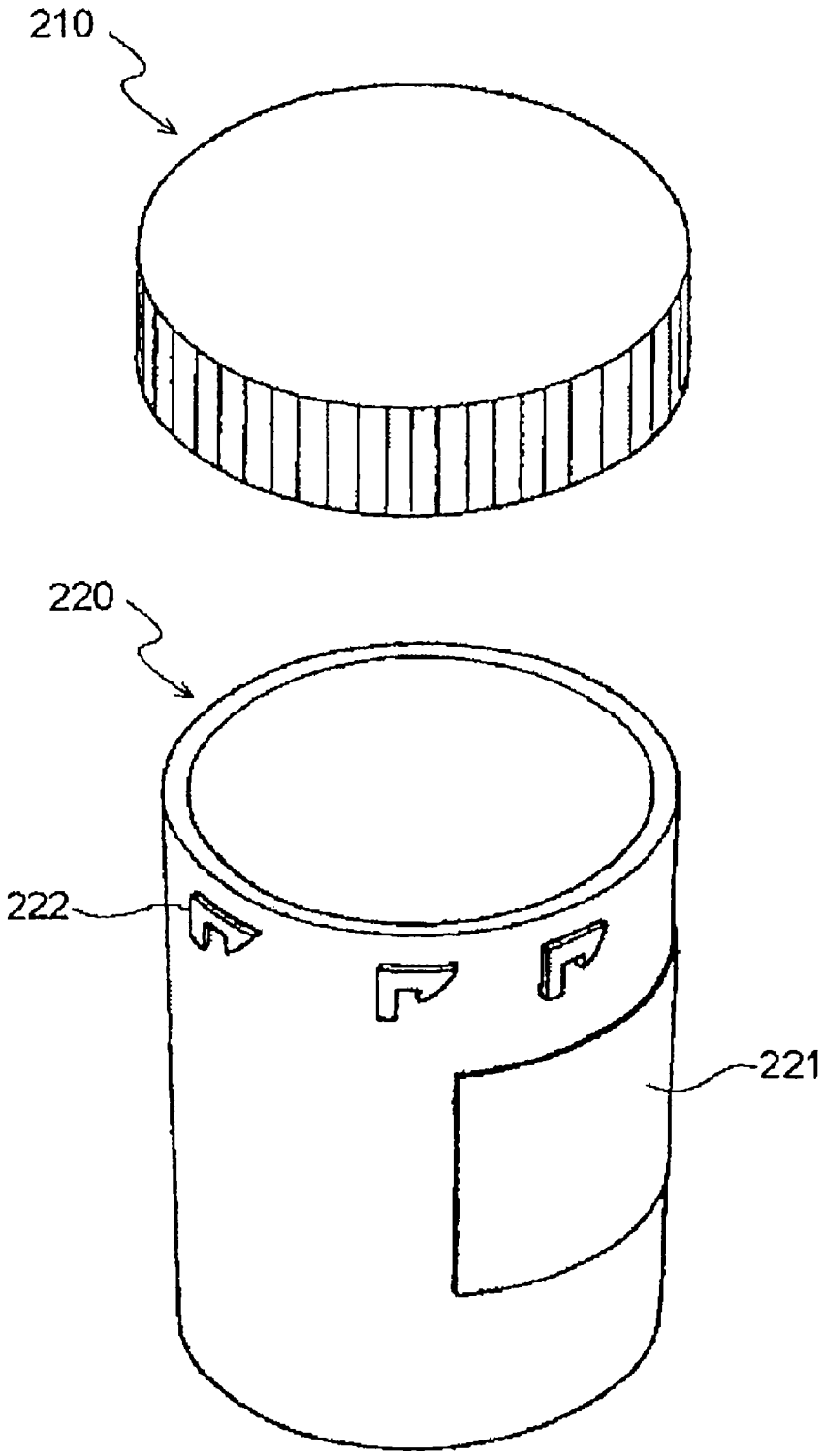
Figure 17 BACKGROUND ART
FIG. 17 is a perspective view of a conventional vial and a cap.
Figure 18B:
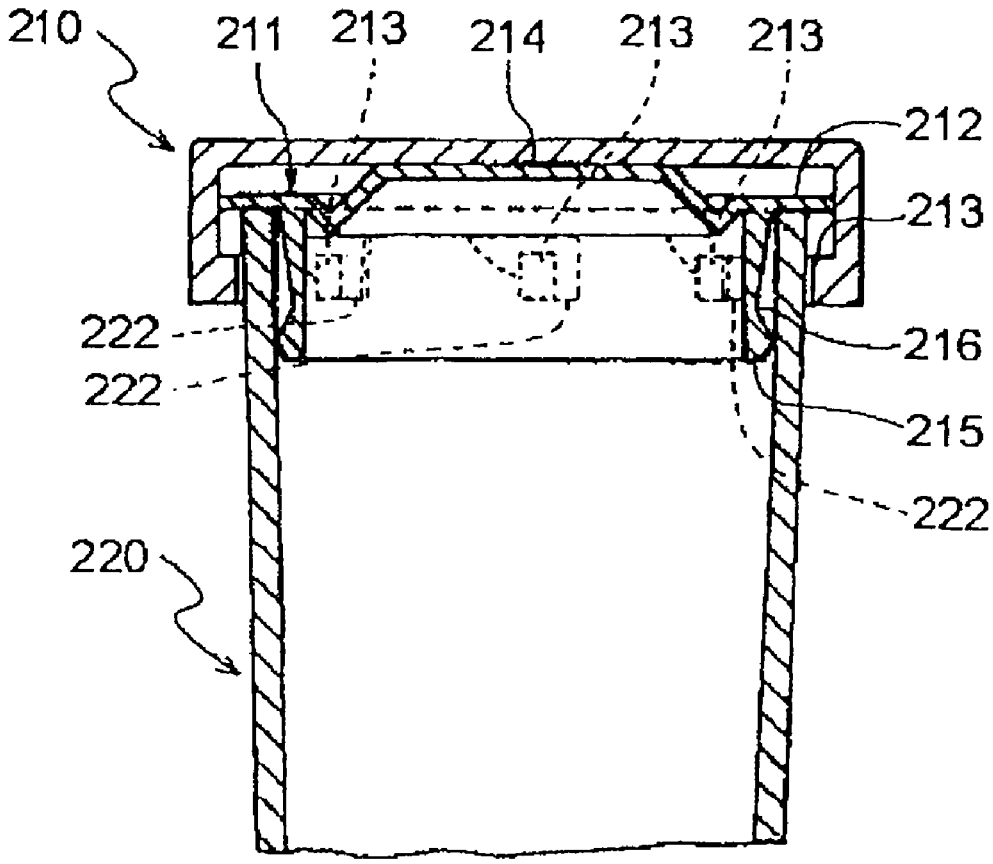
Figure 18B BACKGROUND ART
FIG. 18B is a sectional view of the conventional vial and the cap.
Figure 19:
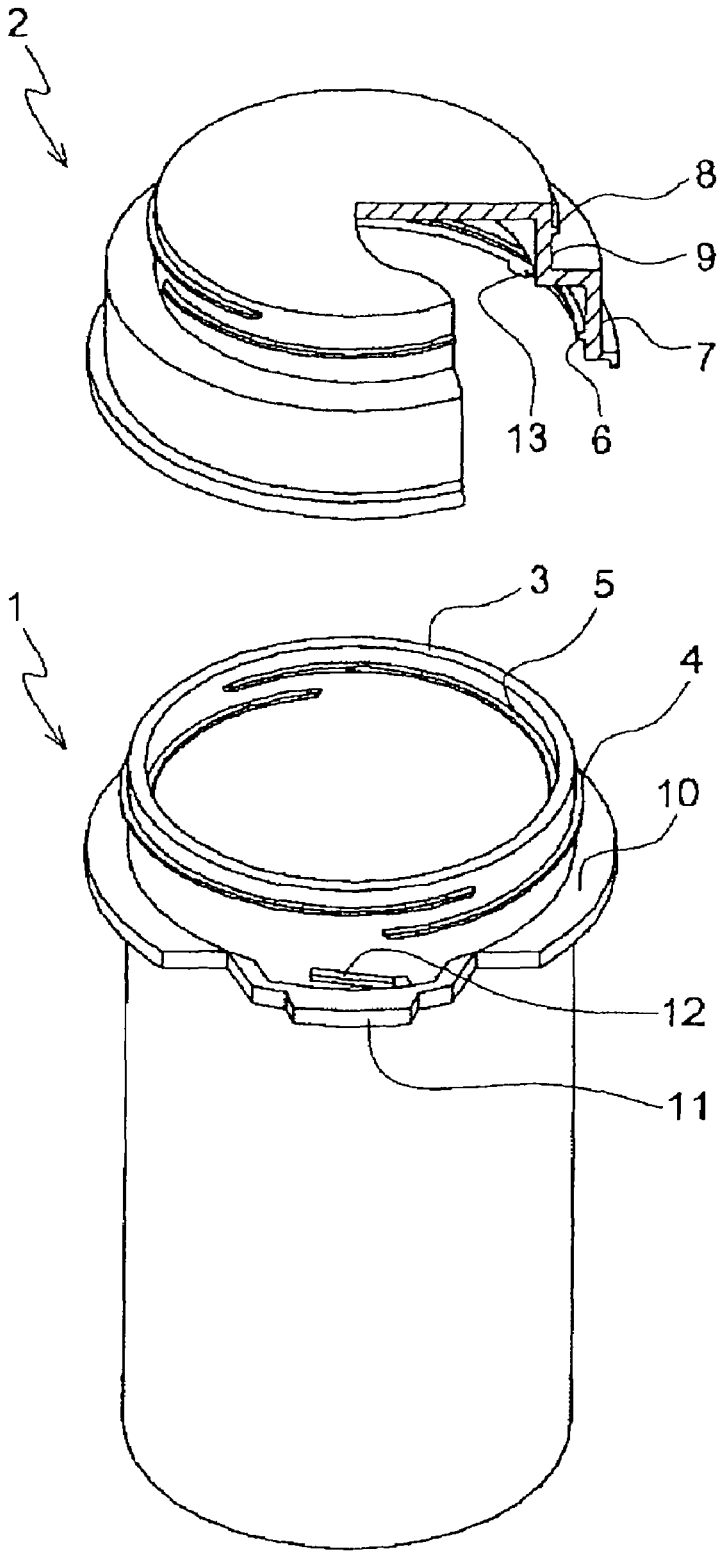
Figure 19 BACKGROUND ART
FIG. 19 is a perspective view of a vial and a cap recently in use.

1: vial
2: cap
31: cap installation unit
33: cap supply portion
34: L-shaped guide
35: cap installation ring
42: rotating motor (as both tightening motor and installation motor)
56: ring inner periphery thread
71: robot arm (as both holding device and movement device)

The invention claimed is: ,

1. A vial capping device to attach a cap to a vial, wherein a thread is provided on each of an inner peripheral surface and an outer peripheral surface of a cap, a thread being provided on an outer peripheral surface of a vial opening, the cap being equipped with an engagement portion, the vial being equipped with a rotation restricting portion, the vial being closed by threadedly engaging the thread of the inner peripheral surface of the cap with the vial opening, and rotation of the cap being locked through engagement of the engagement portion of the cap and the rotation restricting portion of the vial, the vial capping device comprising:

a cap installation ring equipped with an inner periphery thread to be threadedly engaged with the thread of the outer peripheral surface of the cap in axial and rotational directions;

a holding device to hold the vial;

a movement device to move the thread of the inner peripheral surface of the cap attached to the cap installation ring to the thread of the opening of the vial; and a tightening motor to rotate at least one of the cap installation ring and the holding device.

2. The vial capping device according to claim 1, wherein a plurality of cap installation rings are provided to accommodate threads of different diameters.

3. The vial capping device according to claim 2, further comprising:

a torque limiter between the tightening motor and the cap and the vial.

4. The vial capping device according to claim 1, further comprising:

a torque limiter provided between the tightening motor and the cap and the vial.

5. The vial capping device according to claim 4, further comprising:

a cap supply portion is provided below the cap installation ring, the cap is supplied to the cap supply portion so that the cap is substantially coaxial with the cap installation ring, and an approach device to move at least one of the cap supplied to the cap supply portion and the cap installation ring to be closer to each other.

6. The vial capping device according to claim 1, further comprising:

a cap supply portion provided below the cap installation ring, the cap being supplied to the cap supply portion so that the cap is substantially coaxial with the cap installation ring, and an approach device to move at least one of the cap supplied to the cap supply portion and the cap installation ring to be closer to each other.

7. The vial capping device according to claim 6, further comprising:

an installation motor to rotate at least one of the cap and the cap installation ring to threadedly engage the cap installation ring with the cap supplied to the cap supply portion.

8. The vial capping device according to claim 7, further comprising:

a torque limiter provided in a rotation transmission route from the installation motor to the cap or the cap installation ring.

9. The vial capping device according to claim 8, further comprising:

a retraction mechanism to cause the cap supply portion to retract from between the threadedly engaged cap and the vial opening after the cap supplied to the cap supply portion and the cap installation ring have been threadedly engaged with each other.

10. The vial capping device according to claim 6, further comprising:

a retraction mechanism to cause the cap supply portion to retract from between the threadedly engaged cap and the vial opening after the cap supplied to the cap supply portion and the cap installation ring have been threadedly engaged with each other.

11. The vial capping device according to claim 10, further comprising:

a chute to supply a stored cap to the cap supply portion; and a stopper to stop the cap between the cap supply portion and the chute, wherein the stopper is detached to supply a cap when there is no cap at the cap supply portion.

12. A vial capping device according to claim 10, wherein the retraction mechanism includes L-shaped guides to mount the cap on top of the L-shaped guides prior to threadedly engaging the cap installation ring with the cap, and the L-shaped guides are equipped with a spring to urge each of the L-shaped guides towards each other.

13. The vial capping device according to claim 6, further comprising:

a chute to supply a stored cap to the cap supply portion; and a stopper to stop the cap between the cap supply portion and the chute, wherein the stopper is detached to supply a cap when there is no cap at the cap supply portion.

* * * * *